US011267008B2

(12) United States Patent
Ding

(10) Patent No.: US 11,267,008 B2
(45) Date of Patent: Mar. 8, 2022

(54) SPRINGLESS PUMP AND CONTAINER CONTAINING SPRINGLESS PUMP

(71) Applicant: Yaowu Ding, Jiangsu (CN)

(72) Inventor: Yaowu Ding, Jiangsu (CN)

(73) Assignee: Yaowu Ding, Jiangsu (CN)

( * ) Notice: Subject to any disclaimer, the term of this patent is extended or adjusted under 35 U.S.C. 154(b) by 0 days.

(21) Appl. No.: 16/765,616

(22) PCT Filed: Aug. 13, 2018

(86) PCT No.: PCT/CN2018/100163
§ 371 (c)(1),
(2) Date: May 20, 2020

(87) PCT Pub. No.: WO2019/100765
PCT Pub. Date: May 31, 2019

(65) Prior Publication Data

US 2020/0298263 A1 Sep. 24, 2020

(30) Foreign Application Priority Data

Nov. 21, 2017 (CN) ..... 201711165573.X

(51) Int. Cl.
*B05B 11/00* (2006.01)
*B65D 35/10* (2006.01)
*B65D 35/28* (2006.01)

(52) U.S. Cl.
CPC ..... *B05B 11/3042* (2013.01); *B05B 11/3001* (2013.01); *B05B 11/3011* (2013.01);
(Continued)

(58) Field of Classification Search
CPC . B05B 11/3042; B05B 11/00; B05B 11/3011; B05B 11/3057; B05B 11/3084;
(Continued)

(56) References Cited

U.S. PATENT DOCUMENTS 2,796,204 A * 6/1957 Math ..... F04B 9/02 222/324
3,799,447 A * 3/1974 Beal ..... B05B 9/01 239/288.5

(Continued)

FOREIGN PATENT DOCUMENTS

CN 103420021 A 12/2013
CN 207482521 U 6/2018

(Continued)

OTHER PUBLICATIONS

International Search Report and Written Opinion dated Oct. 24, 2018, for corresponding International Application No. PCT/CN2018/100163, filed on Aug. 13, 2018; consisting of 11-pages.

*Primary Examiner* — Frederick C Nicolas
(74) *Attorney, Agent, or Firm* — Christopher & Weisberg, P.A.

(57) ABSTRACT

Disclosed is a springless pump (100) mounted on a container and used for pumping a product contained in the container. The springless pump (100) may include a movable part having at least a pressing head (110) and/or a piston rod (150) and a stationary part having at least a threaded sleeve (120). Further, the springless pump (100) may have a restoring mechanism, including a transmission component (130), the transmission component (130) being connected to the movable part and a bearing component (140), the bearing component (140) being formed on or fixedly connected to the stationary part, and the transmission component (130) being rigid and being supported on the bearing component (140). The springless pump (100) allows a user to easily restore same.

19 Claims, 26 Drawing Sheets

(52) U.S. Cl.
CPC ..... *B05B 11/3014* (2013.01); *B05B 11/3047* (2013.01); *B05B 11/3057* (2013.01); *B05B 11/3084* (2013.01); *B65D 35/10* (2013.01); *B65D 35/28* (2013.01)

(58) Field of Classification Search
CPC ..... B05B 11/3014; B05B 11/3047; B05B 11/3001; B65D 35/10; B65D 35/28
See application file for complete search history.

(56) References Cited

U.S. PATENT DOCUMENTS 4,124,148 A * 11/1978 Vieler ..... B05B 11/3052 222/321.8
4,186,855 A * 2/1980 Edman ..... B05B 11/3057 222/321.8
5,249,713 A * 10/1993 Reich ..... B65D 83/206 222/321.8
5,673,824 A * 10/1997 Evans ..... B05B 11/0005 222/321.1
5,727,716 A * 3/1998 Hochstein ..... B05B 11/3057 222/321.8
5,887,760 A * 3/1999 Johnson ..... B67D 1/0425 222/209
6,033,384 A * 3/2000 Py ..... A61F 9/0026 604/186
10,138,971 B1 * 11/2018 Deman ..... B05B 11/0037
2001/0054626 A1 * 12/2001 Bethune ..... B05B 11/3074 222/340
2004/0149777 A1 * 8/2004 Santagiuliana ..... B05B 11/3023 222/190
2008/0251538 A1 * 10/2008 Carta ..... B05B 11/3059 222/153.13
2012/0241474 A1 * 9/2012 Dennis ..... B05B 11/3084 222/137
2012/0241475 A1 * 9/2012 Dennis ..... B05B 11/3009 222/137
2014/0061252 A1 * 3/2014 Sweeton ..... B05B 11/3077 222/321.8
2015/0136810 A1 * 5/2015 Ding ..... B05B 11/305 222/321.9

FOREIGN PATENT DOCUMENTS

JP H09301410 A 11/1997
JP H1059404 A 3/1998
JP 2005162222 A 6/2005
JP 2010235185 A 10/2010
JP 2015224075 A 12/2015
JP 2017119544 A * 7/2017 ..... B05B 11/0037

* cited by examiner

SPRINGLESS PUMP AND CONTAINER CONTAINING SPRINGLESS PUMP

CROSS-REFERENCE TO RELATED APPLICATIONS

This application is a submission under 35 U.S.C. § 371 for U.S. National Stage Patent Application of, and claims priority to, International Application Number PCT/CN2018/100163 entitled SPRINGLESS PUMP AND CONTAINER COMPRISING SPRINGLESS PUMP filed Aug. 13, 2018, which is related to and claims priority to Chinese Application Serial No. 201711165573.X, filed Nov. 21, 2017, the entirety of all of which are incorporated herein by reference.

TECHNICAL FIELD

The present invention relates to a pump, and more particularly to a springless pump. The present invention further designs a container comprising the springless pump.

BACKGROUND ART

In fields such as toiletries, containers for containing products generally comprise pumps for dispensing the products. Generally, the pumps for dispensing the products include press pumps and hand-triggered pumps. Users pump the products by applying pressure to pressing heads (for press pumps) or triggers (for hand-triggered pumps) of the pumps. After pumping the product once, a restoring mechanism mounted on the pump will restore an actuation member to an unpressed position for the next pumping.

Conventional pumps use metal springs to restore the pumps. With the increasing requirements for environmental protection and the need to control the manufacturing cost of the pumps, the concept of a springless pump has been proposed.

FIGS. 42 to 43*b* show a springless press pump 1 of the prior art. As shown in the cross-sectional views of FIGS. 43*a* and 43*b*, the press pump 1 comprises a pressing head 10, a piston rod 20, a threaded sleeve 30, and a cylinder 40, wherein the piston rod 20 is connected to the pressing head 10 and extends into the cylinder 40, and the threaded sleeve 30 is connected to the cylinder 40. It can be seen that a restoring mechanism such as a metal spring is omitted in the press pump 1. In order to restore the pressing head 10 of the press pump 1 after pressing, the pressing head 10 is provided with a tab 11 (see FIG. 42), and the pressing head 10 can be restored upward by applying an upward force to the bottom of the tab 11.

FIGS. 44*a* and 44*b* show another springless press pump 1'. As clearly seen from the cross-sectional view of FIG. 44*b*, the press pump simply omits a spring. After pressing a pressing head 10' to dispense a product, a user pulls the pressing head 10' upward to achieve the restoring thereof.

For the existing springless press pump disclosed above, in the process of pulling the pressing head upward, the user needs to hold a container containing the product or other parts of the press pump with the other hand, otherwise, pulling the pressing head with a single hand makes it easy to lift the entire container. This results in the inconvenient use of the springless press pumps of the prior art. Similarly, the hand-triggered pumps have the similar problem.

Therefore, there is a need for improvement of the springless pumps to overcome the aforementioned inconvenience of use in the prior art.

SUMMARY OF THE INVENTION

The present invention is made based on the technical problem existing in the prior art described above, and its object is to provide an improved springless pump which allows operation with a single hand, is easy to use, and conforms to the usual usage habits of the pump.

The present invention provides an improved springless pump mounted on a container and used for pumping a product contained in the container, which springless pump comprises:

a movable part comprising at least a pressing head and/or a piston rod; and a stationary part comprising at least a threaded sleeve, the springless press pump further comprising a restoring mechanism, the restoring mechanism comprising: a transmission component connected to the movable part; and a bearing component formed on or fixedly connected to the stationary part, wherein the transmission part is rigid, and is supported on the bearing component.

In the springless pump with the above structure, with the provision of the restoring mechanism, a user is enabled to easily operate the restoring mechanism after the pump performs a pumping operation to dispense the product, so as to restore the pump for the next operation. Moreover, since the spring is omitted by providing the restoring mechanism, the operation of the springless pump is labor-saving.

Preferably, the transmission part is a rigid member, so that when the user operates the transmission member, the force exerted by the user can be transmitted more effectively, thereby further making the operation of the springless pump labor-saving.

Preferably, the transmission part is rotatably or pivotably supported on the bearing component. In this way, the movable part such as the pressing head or the piston rod can be restored more effectively by the rotation or pivoting movement of the transmission part.

One type of the springless pump is a press pump comprising the pressing head and the piston rod, wherein the piston rod is connected to the pressing head, and wherein a transmission component of a restoring mechanism is connected to the pressing head or the piston rod.

Further, in a specific implementation structure, the transmission component comprises a pressing plate, the pressing plate comprising a pressing head mating portion located at one end of the pressing plate and a pressing portion at the other end of the pressing plate, and the pressing head mating portion being engaged with the pressing head; and the bearing component comprises a fulcrum portion, and the pressing plate further comprises a pivoting portion rotatably supported on the fulcrum portion.

In this way, by virtue of the action of the pressing plate, the press pump can be easily restored by pressing one end of the pressing plate.

Further, the pressing head mating portion of the pressing plate is in the shape of a fork, and two arms of the fork clamp a neck of the pressing head from two sides; and/or the stationary part further comprises a cylinder head, and the bearing component further comprises a fixing portion, the fixing portion being ring-shaped and being snapped between the threaded sleeve and the cylinder head.

Alternatively, the pressing head mating portion may be connected to the top of the pressing head.

In another specific implementation structure, the springless press pump is a dual-body pump for use in a container comprising two chambers, and the dual-body pump comprises two pressing heads, namely a first pressing head and a second pressing head, and two mounting holes are formed in the top of the threaded sleeve, the first pressing head and the second pressing head being respectively mounted in the mounting holes.

Preferably, in the springless press pump in the form of a dual-body pump, the transmission component comprises a pressing plate, the pressing plate comprising a pivoting portion and first and second pressing head mating portions located on two sides of the pivoting portion, wherein the first pressing head mating portion is connected to the first pressing head or to a first piston rod connected to the first pressing head, and the second pressing head mating portion is connected to the second pressing head or to a second piston rod connected to the second pressing head; and the bearing component comprises a fulcrum portion formed on the top of the threaded sleeve, wherein the fulcrum portion is located between the two mounting holes, and the pivoting portion of the pressing plate is rotatably mated on the fulcrum portion.

Further, support rods are respectively formed on the tops of the first pressing head and the second pressing head, a first connection point is formed at the first pressing head mating portion, the first connection point is connected to the support rod on the first pressing head, a second connection point is formed at the second pressing head mating portion, and the second connection point is connected to the support rod on the second pressing head.

Further preferably, further comprised is a clip snapped, when the springless press pump is not operated, to a neck of the first pressing head and/or a neck of the second pressing head to prevent the downward movement of the first pressing head and/or the second pressing head. In a specific structure, the pressing plate is detachable, and the clip is integrated onto the pressing plate.

Alternatively, in the case of the dual-body pump, the transmission component is in the form of a connecting rod, and the structure of the connecting rod is as follows: a first end thereof is provided with at least one first aperture, a first piston rod is connected to the first pressing head, at least one first protruding post is formed on an outer peripheral wall of the first piston rod, and the first aperture is mated with the first protruding post;

a second end of the connecting rod is provided with at least one second aperture, a second piston rod is connected to the second pressing head, at least one second protruding post is formed on an outer peripheral wall of the second piston rod, and the second aperture is mated with the second protruding post; and a pivoting portion is formed between the first end and the second end of the connecting rod, and the bearing component comprises a fulcrum portion formed on the top of the threaded sleeve, wherein the fulcrum portion is located between the two mounting holes, and the pivoting portion of the connecting rod is rotatably mated on the fulcrum portion.

In another specific structure, the transmission component comprises a gear train, and the bearing component comprises a gear mounting portion formed at the top of the threaded sleeve, wherein the gear train comprises:

a gear rotatably mounted on the gear mounting portion, a first rack, which is formed on a first piston rod connected to the first pressing head, and meshes with one side of the gear; and a second rack, which is formed on a second piston rod connected to the second pressing head, and meshes with the other side of the gear.

In the case where the transmission component of the restoring mechanism is in the form of a pressing plate, the fulcrum portion may be any one of the following forms: the fulcrum portion may be formed on the threaded sleeve, or the fulcrum portion may be clamped and fixed between the threaded sleeve and the container, or the fulcrum portion may be formed on the container.

Further, a rod part of the fulcrum portion mentioned above is foldable, and comprises a first segment and a second segment, the first segment being able to be switched between a first position in which the first segment is folded on the second segment, and a second position in which the first segment is aligned with the second segment to form a straight line. In this way, during the storage and transportation, the rod portion of the fulcrum portion can adopt a folded state, thereby allowing the pressing head to be in a depressed state to facilitate storage and transportation.

Alternatively, the following structure may also be used to facilitate storage and transportation: the fulcrum portion comprises a sleeve and a ratcheted rod, wherein one end of the ratcheted rod is connected to the pressing plate, and the other end of the ratcheted rod comprises a ratchet and is slidably accommodated in the sleeve.

In another embodiment, the transmission component comprises a rotary restoring member, the rotary restoring member comprises an operation portion and at least one abutment portion suspended from a body of the rotary restoring member, and a slope is formed on a free end of the abutment portion. Correspondingly, the bearing component comprises a mating slope formed on a neck of the threaded sleeve, and the mating slope is mated with the slope of the abutment portion. By means of the mating between the slope of the abutment portion and the mating slope of the neck of the threaded sleeve, when the operation portion is operated to rotate the rotary restoring member in one direction, the rotary restoring member can be raised, and the pressing head is in turn lifted to restore same.

Another type of the springless pump is a hand-triggered pump, wherein the stationary part comprises the threaded sleeve and a cylinder formed or mounted on the threaded sleeve, and the movable part comprises a piston rod reciprocably accommodated in the cylinder and a trigger, a first end of the trigger being connected to the piston rod, and a second end of the trigger being a free end; and wherein the bearing component is a fulcrum portion formed on the stationary portion, and the trigger is rotatably connected to the fulcrum portion at an intermediate point between the first end and the second end, such that a part of the trigger between the intermediate point and the second end constitutes the transmission part of the restoring mechanism.

By means of the structure, the user can, by alternately pressing the first end and the second end of the trigger, easily realize the pumping of the product and restore the pump after the pumping is completed.

Preferably, a limiting member is further formed on the fulcrum portion. The limiting member can limit the movement range of the trigger when the pump is restored, to prevent the pump from being excessively restored.

The present invention further relates to a container comprising a springless pump as described above.

Further, the container is a dual-chamber container, and comprises a springless pump in the form of a dual-body pump as described above, wherein the container further comprises a pump housing for covering the springless press pump, the top of the pump jacket is step-shaped and comprises a higher top face and a lower top face, the height of the higher top face corresponds to an upper dead point of a stroke of one of the first pressing head and the second pressing head, and the height of the lower top face corresponds to a lower dead point of a stroke of the other of the first pressing head and the second pressing head.

DETAILED DESCRIPTION OF EMBODIMENTS

Figure 1:
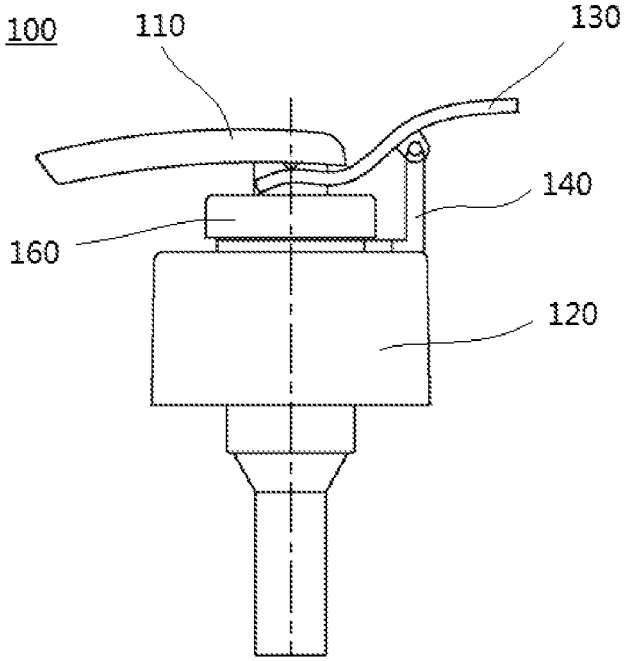
FIG. 1 shows a side view of a pump of a first embodiment of the present invention, with the pump being a press pump, and a pressing head thereof being in a depressed state.
Figure 2:
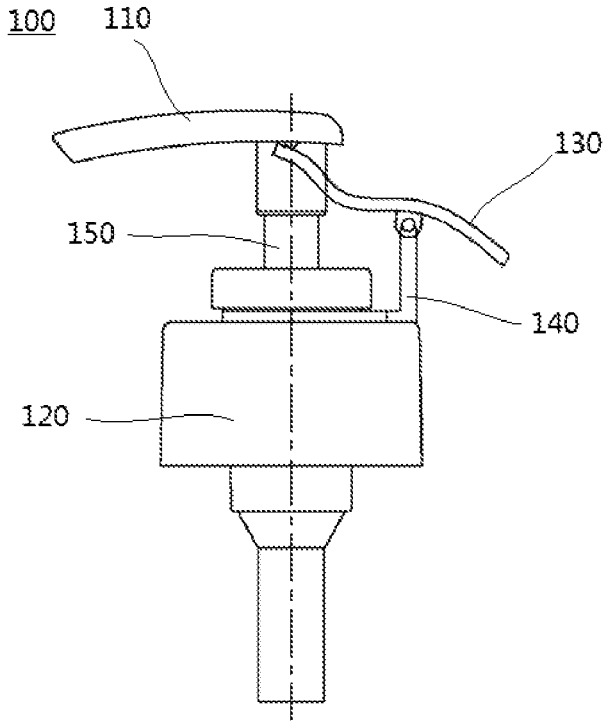
FIG. 2 shows another side view of the press pump shown in FIG. 1, with the pressing head being in a restored state.

In order to facilitate the understanding of the present invention, specific embodiments of the present invention will be described below with reference to the accompanying drawings. It should be appreciated that only preferred embodiments of the present invention are shown in the accompanying drawings and are not intended to constitute a limitation to the scope of the present invention. Various obvious modifications, variations and equivalent substitutions of the present invention can be made by those skilled in the art based on the embodiments shown in the drawings, and the technical features in the various embodiments described below can be arbitrarily combined without causing contradictions. These all fall within the scope of protection of the present invention.

First Embodiment

FIGS. 1 to 6 show a press pump 100 of a first embodiment of the present invention. The press pump 100 comprises a movable part and a stationary portion, wherein the movable part comprises, for example, a pressing head 110, and a piston rod 150 and other components connected to the pressing head 110; and the stationary portion comprises, for example, a threaded sleeve 120, a cylinder, a cylinder head 160 and other components.

Figure 3:
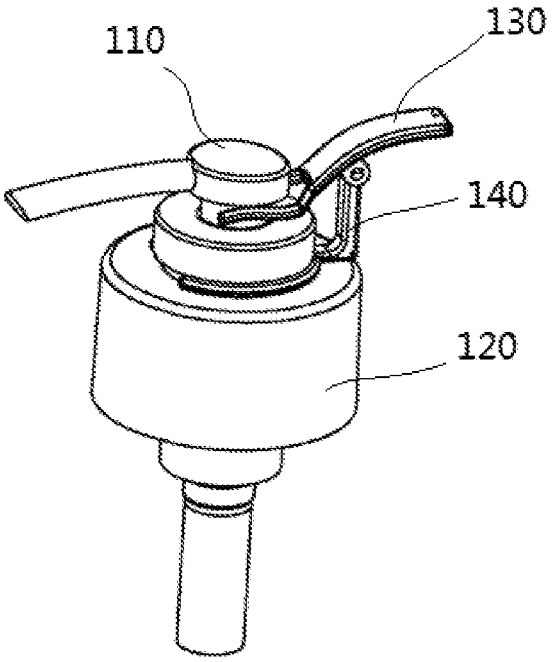
FIG. 3 shows a perspective view of the press pump shown in FIGS. 1 and 2.
Figure 5A:
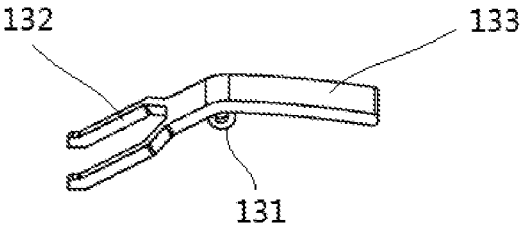
FIG. 5*a* shows a perspective view of a pressing plate of the press pump shown in FIG. 1.
Figure 5B:
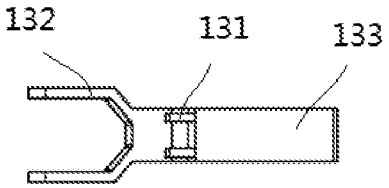
FIG. 5*b* shows a bottom view of the pressing plate shown in FIG. 5*a*.
Figure 6:
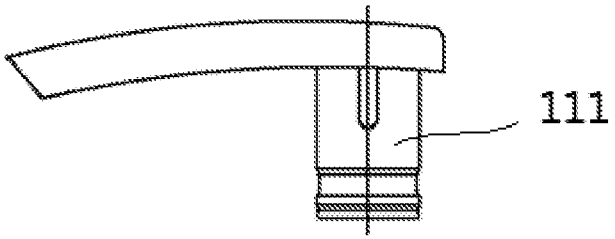
FIG. 6 shows a side view of the pressing head of the press pump shown in FIG. 1.

Further, the press pump 100 of the first embodiment is further provided with a pressing plate 130. As shown in FIGS. 5*a* and 5*b*, the pressing plate 130 comprises a pivoting portion 131, a pressing head mating portion 132 on one side of the pivoting portion 131, and a pressing portion 133 on the other side of the pivoting portion 131. As shown in FIG. 3, the pressing head mating portion 132 is connected to the pressing head 110. In a preferred structure shown in the figures, the pressing head mating portion 132 is in the shape of a fork. In a mounted state, two arms of the fork clamp a pressing head neck 111 of the pressing head 110 from two sides. The pressing portion 133 is a free end of the pressing plate 130, and a user can apply a pressing force on the pressing portion 133 to move the pressing portion 133 downward. Alternatively, the two arms of the fork may clamp two sides of a piston rod (not shown) connected to the pressing head 110.

It can be seen that the pressing plate 130 can pivot about the pivoting portion 131 when the user applies a pressing force to the pressing portion 133 or applies a downward pressure to the pressing head mating portion 132 via the pressing head. The pressing plate 130 is preferably of a rigid structure, which is beneficial to more effectively transferring the pressure applied by the user, thereby enabling the user to operate more effectively. In addition, in order to be able to further effectively operate the pressing plate 130, preferably, the pressure applied to the pressing plate 130 is substantially perpendicular to the pressing plate 130.

Figure 4:
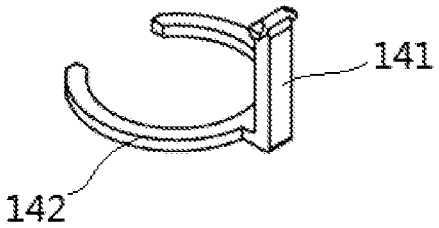
FIG. 4 shows a perspective view of a bearing component of the press pump shown in FIG. 1.

In order to provide a fulcrum for the pressing plate 130, a bearing component 140 is provided on the stationary portion of the press pump 100. FIG. 4 shows a perspective view of the bearing component 140. The bearing component 140 comprises a fulcrum portion 141 and a fixing portion 142. The pivoting portion 131 of the pressing plate 130 is connected to the fulcrum portion 141, such that the pressing plate 130 can pivot about the pivoting portion 131. The fixing portion 142 is fixedly connected to the stationary portion of the press pump 100. For example, in the structure shown in the figures, the fixing portion 142 is partially ring-shaped, and is snapped in a gap between the threaded sleeve 120 and the cylinder head 160 as shown in the figures.

Of course, the bearing component 140 may also be formed in another form on the stationary part of the press pump 100 and provides a fulcrum for the pressing plate 130. For example, the fixing portion 142 may be welded to the stationary portion of the press pump 100, and it is not necessary for the fixing portion 142 to be partially ring-shaped. Moreover, in addition to the threaded sleeve 120 shown in the figures, the fixing portion 142 may also be fixed to other components of the stationary part, for example, to the cylinder head, etc. Indeed, the fixing portion 142 may be omitted, and the fulcrum portion 141 for supporting the pivoting portion 131 of the pressing plate 130 is integrally formed on the stationary portion of the press pump 100.

The operation principle of the press pump 100 of the above structure will be described in detail below.

When a product in a container on which the press pump 100 is mounted needs to be used, the user presses the pressing head 110 to dispense the product. Then, if the pressing head 110 is to be restored, the user only needs to press the pressing portion 133 of the pressing plate 130, thereby moving the pressing portion 133 downward, and in turn pivoting the pressing plate 130 about the pivoting portion 131, such that the pressing head mating portion 132 moves upward. The pressing head mating portion 132 abuts against the pressing head 110 during the upward movement, such that the pressing head 110 also moves upward along therewith, thereby restoring same. It can be seen that by the pivoting movement of the pressing plate 130 about the pivoting portion 131, the user can apply, with a simple action, a force alternately on portions of the pressing plate 130 that are located on two sides of the pivoting portion 131, so that the pressing head 110 can be easily restored.

Second Embodiment

Figure 7:
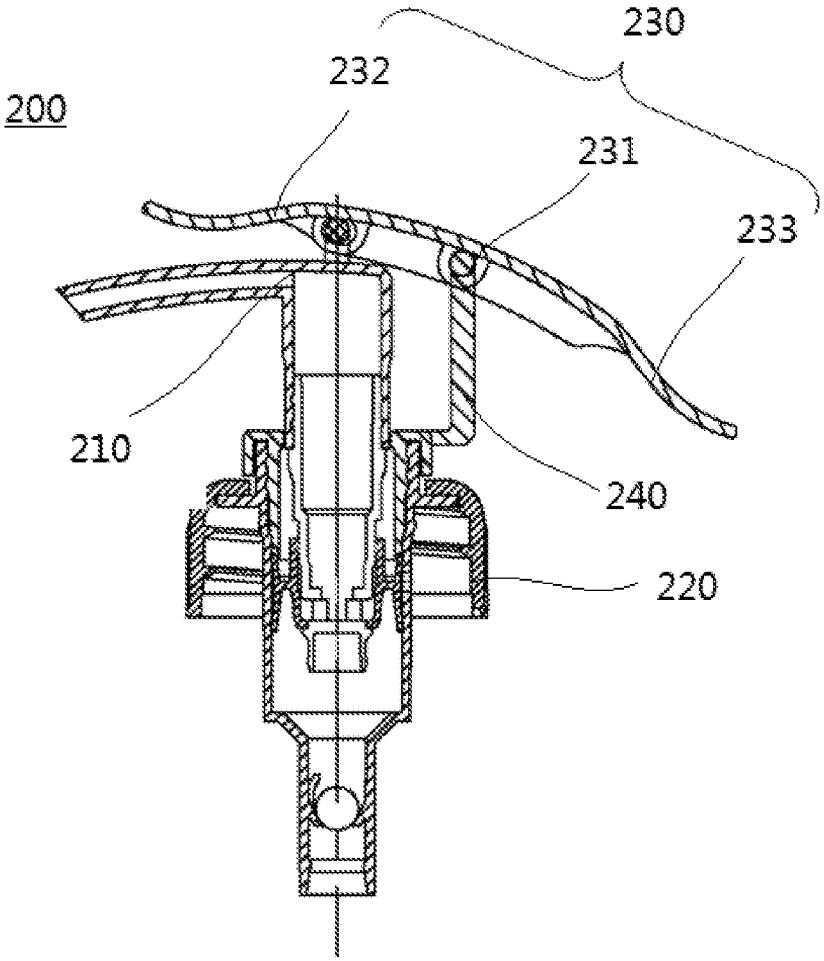
FIG. 7 shows a side cross-sectional view of a pump of a second embodiment of the present invention, the pump being a press pump.

FIG. 7 shows a press pump 200 of a second embodiment of the present invention. In the following description of the second embodiment, for the sake of brevity, the features that are not included in the first embodiment are mainly described, and the same technical features as those of the first embodiment will not be described in detail.

As shown in FIG. 7, the press pump 200 also comprises a movable part such as a pressing head 210 and a stationary part such as a threaded sleeve 220, and further comprises a pressing plate 230. The pressing plate 230 comprises a pivoting portion 231, a pressing head mating portion 232 on one side of the pivoting portion 231, and a pressing portion 233 on the other side of the pivoting portion 231. The pivoting portion 231 is pivotably connected to a bearing component 240 which is provided on the stationary part such as the threaded sleeve 220.

Different from the press pump 100 of the first embodiment, the pressing head mating portion 232 of the pressing plate 230 of the press pump 200 of the second embodiment is connected to an upper portion of the pressing head 210, particularly to the top of the pressing head 210.

The operation principle of the press pump 200 of the second embodiment will be described below.

When a product in a container on which the press pump 200 is mounted needs to be used, the user can press the pressing head mating portion 232 of the pressing plate 230, and in turn press the pressing head 210 down via the pressing head mating portion 232, and the pressing plate 230 pivots about the pivoting portion 231. After the product is dispensed from the container, the user can press the pressing portion 233 of the pressing plate 230 to pivot the pressing plate 230 about the pivoting portion 231 in the opposite direction, thereby raising the pivoting portion 231 upward, and pulling the pressing head 210 upward via the pressing head mating portion 232 to restore the pressing head 210. It can be seen that during the operation of the press pump 200, the user can press the pressing head mating portion 232 and the pressing portion 233 of the pressing plate 230 alternately with the same hand to achieve the pressing of the pressing head 210 of the press pump 200 and the restoring of the pressing head 210, and the user's hand can maintain the same posture during operation without changing.

Third Embodiment

FIGS. 8 to 15*b* show a press pump 300 of a third embodiment of the present invention. In the following description of the third embodiment, for the sake of brevity, the features that are not included in the first and second embodiments are mainly described, and the same technical features as those of the first and second embodiments will not be described in detail.

Figure 8:
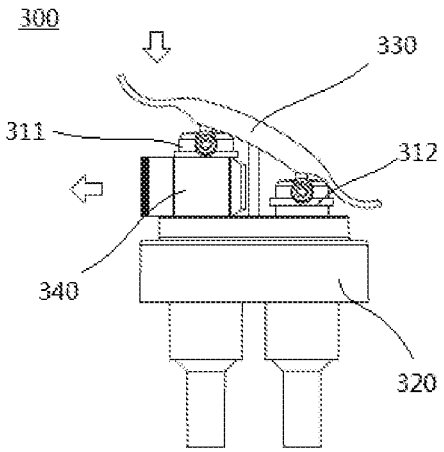
FIG. 8 shows a front view of a pump of a third embodiment of the present invention, the pump being in the form of a dual-body press pump.
Figure 9:
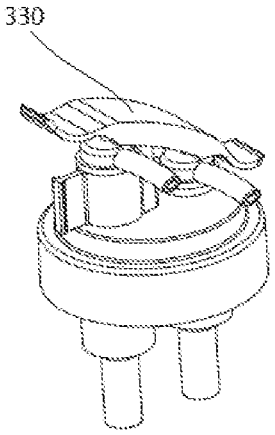
FIG. 9 shows a perspective view of the dual-body press pump shown in FIG. 8.
Figure 15A:
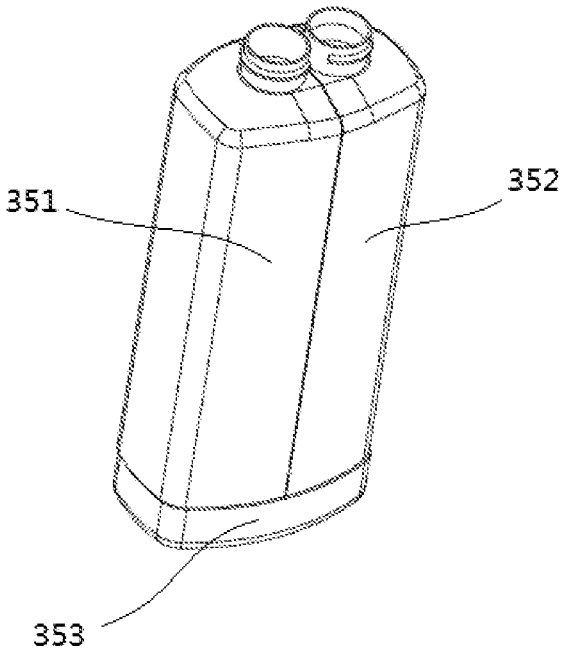
FIG. 15*a* shows a perspective view of a dual-chamber container with the press pump shown in FIG. 8 being mounted thereon.
Figure 15B:
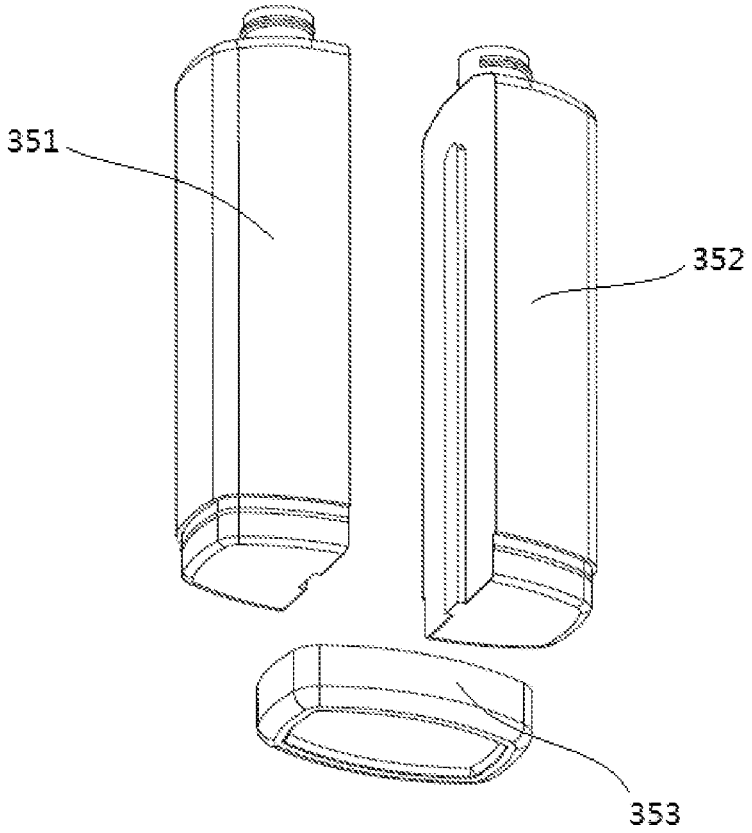
FIG. 15*b* shows an exploded perspective view of the dual-chamber container shown in FIG. 15*a*.

As shown in FIGS. 8 and 9, the press pump 300 of the third embodiment of the present invention is a dual-body pump, which is used in, for example, a double-chamber container. The structure of the dual-chamber container is shown in FIGS. 15*a* and 15*b*, wherein the container comprises a first container 351 and a second container 352, and the first container 351 and the second container 352 are mated on the same base 353. Of course, the first container 351 and the second container 352 may be two independent containers as shown in the figures, or may be integrally formed, such that the base 353 is omitted.

The press pump 300 comprises a threaded sleeve 320. Two pressing heads are mounted on the threaded sleeve 320, namely a first pressing head 311 and a second pressing head 312.

Referring back to FIGS. 8 and 9, the press pump 300 of the third embodiment further comprises a pressing plate 330. The pressing plate 330 is connected to the first pressing head 311 and the second pressing head 312 for alternately pressing the first pressing head 311 and the second pressing head 312.

Figure 11A:
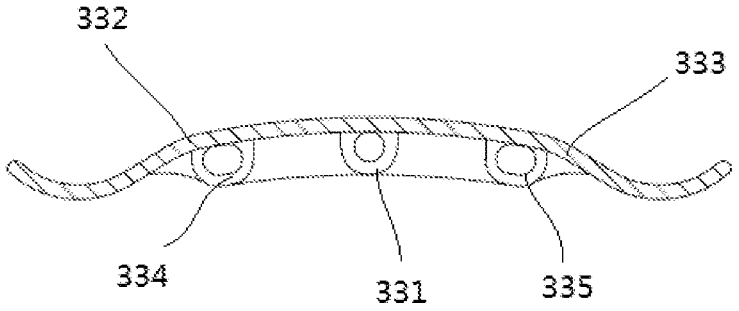
FIG. 11*a* shows a cross-sectional view of a pressing plate of the press pump shown in FIG. 8.
Figure 11B:
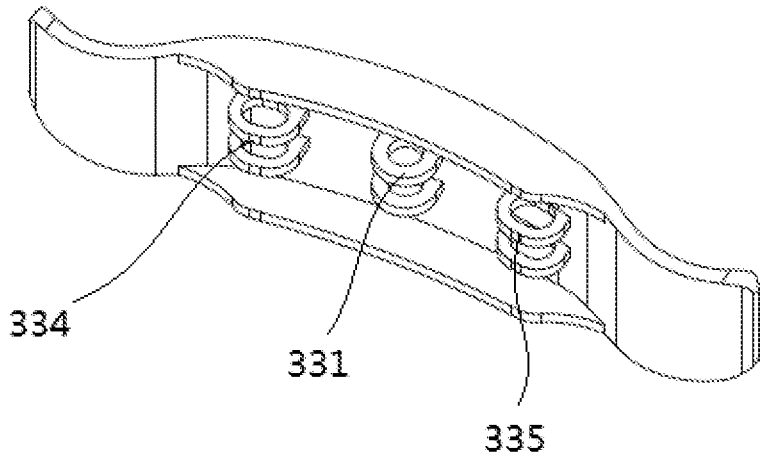
FIG. 11*b* shows a perspective view of the pressing plate shown in FIG. 11*a*.

FIGS. 11*a* and 11*b* show a cross-sectional view and a perspective view of the pressing plate 330, respectively. It can be seen from the figures that the pressing plate 330 comprises a pivoting portion 331. A first pressing head mating portion 332 and a second pressing head mating portion 333 are respectively on two sides of the pivoting portion 331. A first connection point 334 is provided at the first pressing head mating portion 332 and is used to be connected to the first pressing head 311, and a second connection point 335 is provided at the second pressing head mating portion 333 and is used to be connected to the second pressing head 312.

Figure 12A:
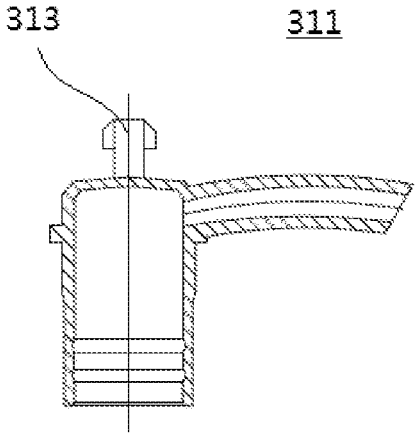
FIG. 12*a* shows a cross-sectional view of a first pressing head of the press pump shown in FIG. 8.
Figure 12B:
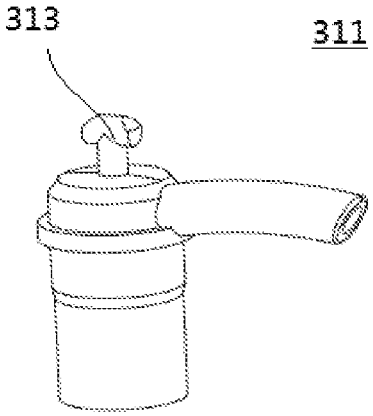
FIG. 12*b* shows a perspective view of the first pressing head shown in FIG. 12*a*.

FIGS. 12*a* and 12*b* show the structure of the first pressing head 311, in which a pressing plate connecting portion is formed on the top of the body of the first pressing head 311. For example, in the structure shown in the figures, the pressing plate connecting portion is in the form of a support rod 313, and two protruding posts extending substantially horizontally are formed at the top of the support rod 313. Correspondingly, the first connection point 334 of the pressing plate 330 comprises two oppositely disposed connection rings (see FIG. 11*b*), and the two protruding posts of the support rod 313 are respectively mated into the two connection rings.

The second pressing head 312 may has the same shape as the first pressing head 311 shown in FIGS. 12*a* and 12*b*, but may also have a different shape from the first pressing head 311 except that the support rod 313 is still provided as shown in the figures.

Figure 13:
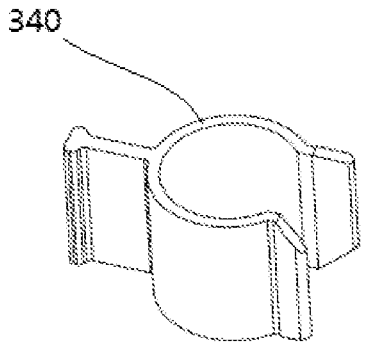
FIG. 13 shows a perspective view of a clip for use in the press pump shown in FIG. 8.

In the press pump 300 of the third embodiment, a clip 340 is further provided. The structure of the clip 340 is shown in FIG. 13. In the state shown in FIG. 8, the clip 340 is snapped to a neck of the first pressing head 311, thereby preventing the first pressing head 311 from being depressed. Of course, the clip 340 may also be snapped to the second pressing head 312 to prevent the second pressing head 312 from being depressed. Further, the clip 340 may also be a double-sided clip, which can be snapped to the first pressing head 311 and the second pressing head 312 at the same time.

Figure 10:
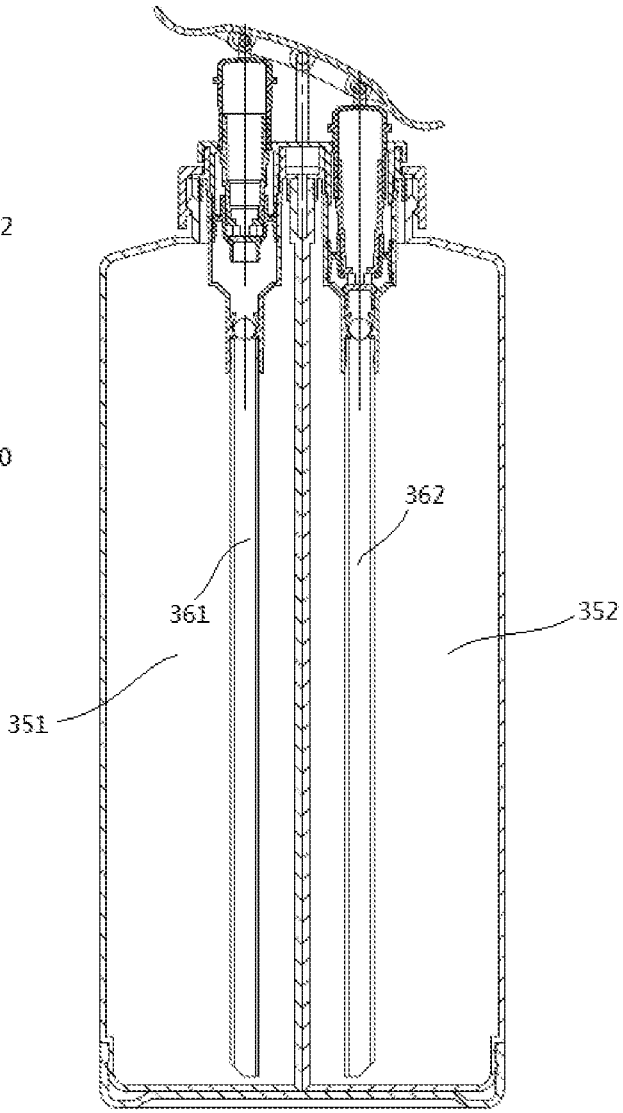
FIG. 10 shows a cross-sectional view of the press pump of the third embodiment when mounted in a corresponding dual-chamber container.
Figure 14A:
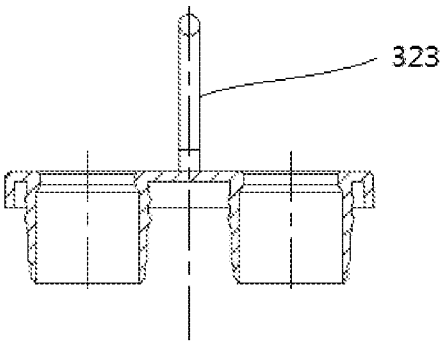
FIG. 14*a* shows a cross-sectional view of a threaded sleeve of the press pump shown in FIG. 8.
Figure 14B:
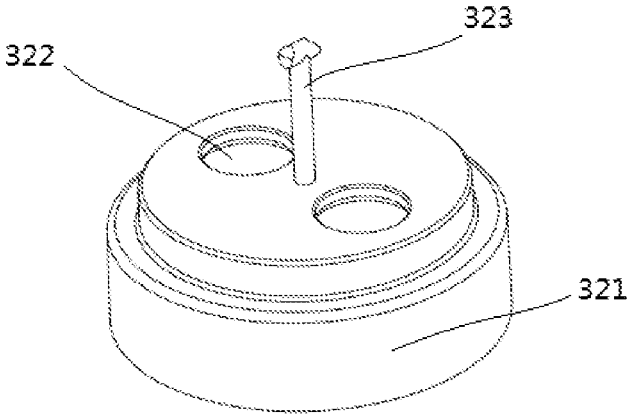
FIG. 14*b* shows a perspective view of the threaded sleeve shown in FIG. 14*a*.

FIGS. 14*a* and 14*b* show the structure of the threaded sleeve 320 of the press pump 300 of the third embodiment. As shown in the figures, the threaded sleeve 320 comprises a threaded sleeve body 321, and two mounting holes 322 are provided in the top of the threaded sleeve body 321 to receive the first pressing head 311 and the second pressing head 312, respectively. Below the two mounting holes 322, suction pipes 361 and 362 are respectively connected, and the two suction pipes 361 and 362 respectively extend into the first container 351 and the second container 352 constituting the two chambers of the container, as shown in FIG. 10.

In addition, a fulcrum portion 323 in the shape of a support rod is formed between the two mounting holes 322. The pivoting portion 331 of the pressing plate 330 is pivotably connected to the fulcrum portion 323.

The operation principle of the press pump 300 of the third embodiment will be described below.

When the user needs to use a product contained in the container, first the clip 340 that is snapped to the first pressing head 311 and/or the second pressing head 312 is removed. Then, the user can place his/her hand on the pressing plate 330, and when the product in the first container 351 needs to be obtained, the user presses the first pressing head mating portion 332 of the pressing plate 330 downward to move the first pressing head 311 downward, such that the product in the first container 351 is pumped out. In the process of pressing the first pressing head mating portion 332 downward, the pressing plate 330 pivots about the pivoting portion 331 such that the second pressing head mating portion 333 moves upward simultaneously.

After the pumping of the product from the first container 351 is completed, the user can press the second pressing head mating portion 333 of the pressing plate 330 downward to move the second pressing head 312 downward, such that the product in the second container 352 is pumped. In this process, the pressing plate 330 pivots about the pivoting portion 331 in the opposite direction, such that the first pressing head mating portion 332 moves upward, thereby restoring the first pressing head mating portion 332.

For the press pump 300 in the form of a dual-body pump having the above structure, depression strokes of the first pressing head 311 and the second pressing head 312 are related to each other by the pressing plate 330. For example, when the pivoting portion 331 is at the midpoint between the first connection point 334 and the second connection point 335, the depression strokes of the first pressing head 311 and the second pressing head 312 are substantially equal, such that the amount of product pumped out of the first container 351 is the same as the amount of product pumped out of the second container 352.

For the above press pump 300 in the form of a dual-body pump, the dual-chamber container on which the press pump 300 is mounted may contain the same product or two different products, for example, the left side contains shampoo and the right side contains a hair conditioner, or the two chambers may contain two products that cannot be mixed during storage but need to be mixed together when in use.

In the case of containing two different products, for example, if the amount of product pumped out of the first container 351 is different from the amount of product pumped out of the second container 352, and there is a certain proportional relationship between the two, and according to this proportional relationship, a proportional relationship between the distance from the pivoting portion 331 to the first connection point 334 and the distance from the pivoting portion 331 to the second connection point 335 can be set.

Fourth Embodiment

FIGS. 16*a* to 17*b* show a press pump 400 of a fourth embodiment of the present invention. In the following description of the fourth embodiment, for the sake of brevity, the features that are not included in the first to third embodiments are mainly described, and the same technical features as those of the first to third embodiments will not be described in detail.

Figure 16A:
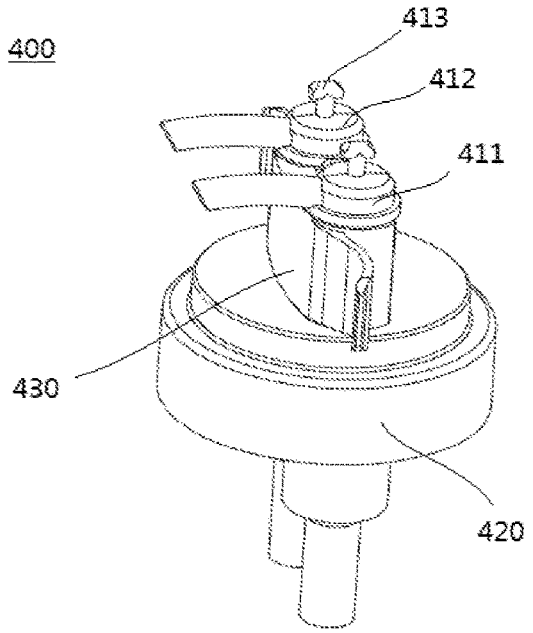
FIG. 16*a* shows a perspective view of a pump of a fourth embodiment of the present invention, the pump being in the form of a dual-body press pump.
Figure 16B:
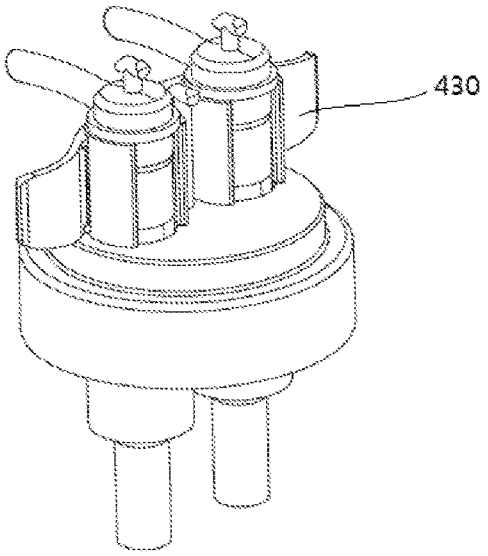
FIG. 16*b* shows another perspective view of the press pump shown in FIG. 16*a*.

Similar to the third embodiment, the press pump 400 of the fourth embodiment is also in the form of a dual-body pump, comprising a threaded sleeve 420. A first pressing head 411 and a second pressing head 412 are mounted on the threaded sleeve 420. Different from the third embodiment, a pressing plate 430 of the press pump 400 can also be used as a clip snapped to the first pressing head 411 and the second pressing head 412, to prevent the first pressing head 411 and the second pressing head 412 from being depressed, as shown in FIGS. 16*a* and 16*b*.

Figure 17A:
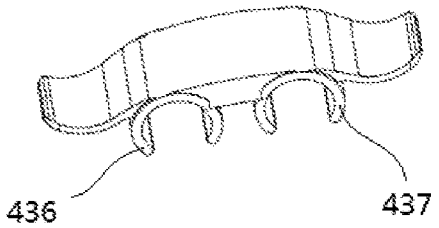
FIG. 17*a* shows a perspective view of a pressing plate of the press pump shown in FIG. 16*a*.
Figure 17B:
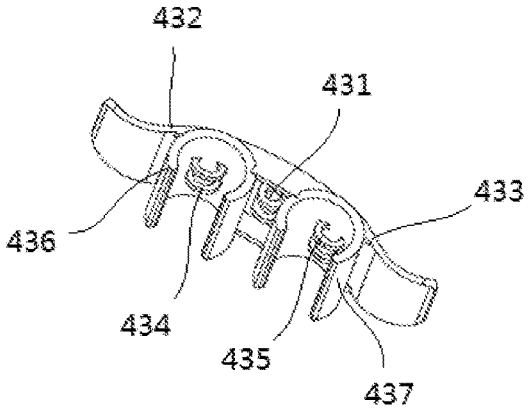
FIG. 17*b* shows another perspective view of the pressing plate shown in FIG. 17*a*.
Figure 18:
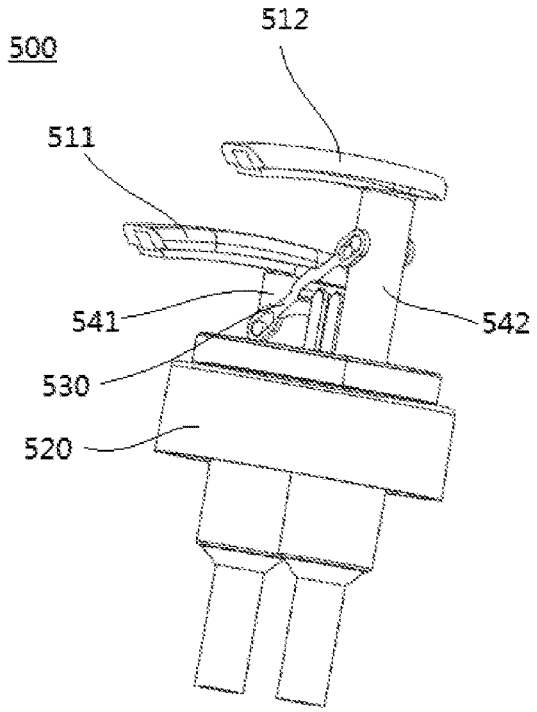
FIG. 18 shows a perspective view of a pump of a fifth embodiment of the present invention, the pump being in the form of a dual-body press pump.
Figure 19:
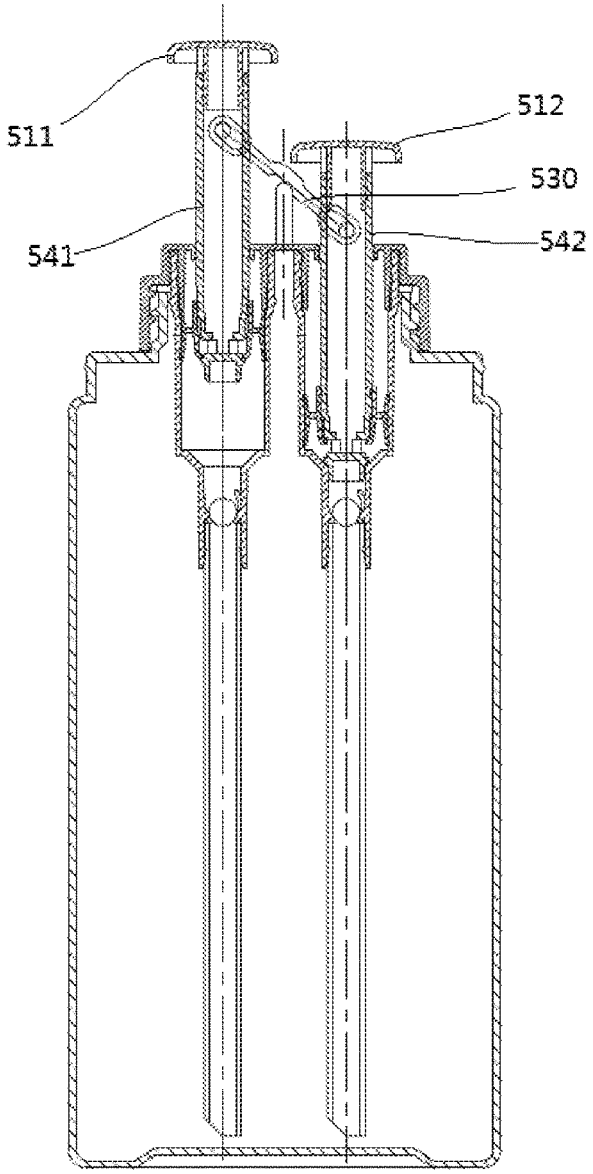
FIG. 19 shows a cross-sectional view of the press pump of the fifth embodiment shown in FIG. 18 when mounted in a corresponding dual-chamber container.

FIGS. 17*a* and 17*b* show the specific structure of the pressing plate 430 of the press pump 400 of the fourth embodiment. As shown in the figures, as in the third embodiment, the pressing plate 430 comprises a pivoting portion 431, and a first pressing head mating portion 432 and a second pressing head mating portion 433 are respectively on two sides of the pivoting portion 431. In addition, a first snapping portion 436 is provided at the first pressing head mating portion 432, and a second snapping portion 437 is provided at the second pressing head mating portion 433. After the use of the press pump 400 is completed, the pressing plate 430 can be removed from support rods 413 on the tops of the first pressing head 411 and the second pressing head 412, and the pressing plate 430 is snapped to the necks of the first pressing head 411 and the second pressing head 412. Specifically, the first snapping portion 436 is snapped to the first pressing head 411, and the second snapping portion 437 is snapped to the second pressing head 412, thereby preventing the first pressing head 411 and the second pressing head 412 from being depressed.

Fifth Embodiment

FIGS. 18 to 22*b* show a press pump 500 of a fifth embodiment of the present invention. In the following description of the fifth embodiment, for the sake of brevity, the features that are not included in the first to fourth embodiments are mainly described, and the same technical features as those of the first to fourth embodiments will not be described in detail.

The press pump 500 of the fifth embodiment is also a dual-body pump, comprising a threaded sleeve 520, and a first pressing head 511 and a second pressing head 512 mounted on the threaded sleeve 520. A first piston rod 541 is connected to the first pressing head 511, a second piston rod 542 is connected to the second pressing head 512, and a connecting rod 530 is mounted between the first pressing head 511 and the second pressing head 512.

Figure 20A:
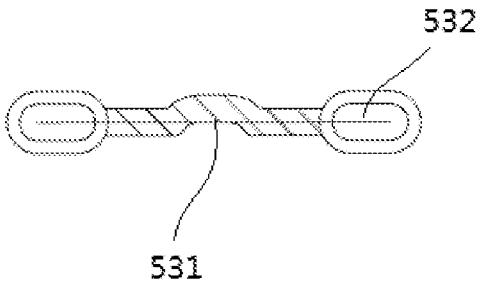
FIG. 20*a* shows a cross-sectional view of a pressing plate of the press pump shown in FIG. 18.
Figure 20B:
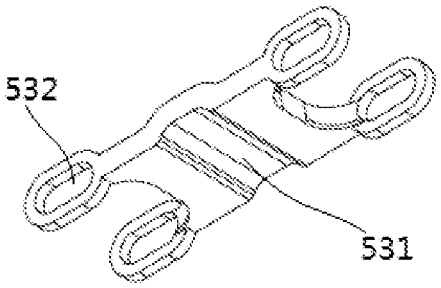
FIG. 20*b* shows a perspective view of the pressing plate shown in FIG. 20*a*.

As shown in FIGS. 20*a* and 20*b*, a pivoting portion 531 is provided at a substantially intermediate position of the connecting rod 530, and the connecting rod 530 can pivot about the pivoting portion 531 in a mounted state. At least one aperture 532 is formed at either end of the connecting rod 530 respectively, and the two ends of the connecting rod 530 are respectively connected to the first pressing head 511 and the second pressing head 512 via the apertures 532, or to the first piston rod 541 of the first pressing head 511 and the second piston rod 542 of the second pressing head 512. In a preferred structure shown in FIGS. 20*a* and 20*b*, the two ends of the connecting rod 530 are respectively formed with two juxtaposed apertures 532, such that a total of four apertures 532 are formed on the connecting rod 530.

Figure 21A:
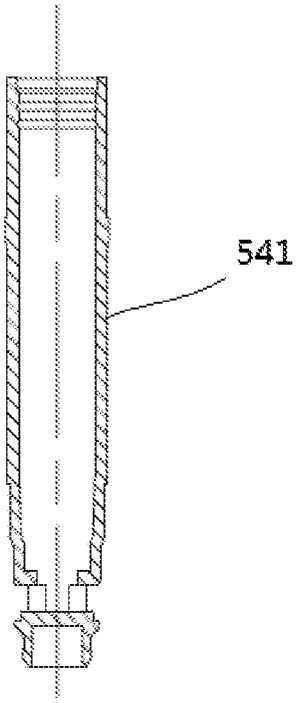
FIG. 21*a* shows a cross-sectional view of a first piston rod of the press pump shown in FIG. 18.
Figure 21B:
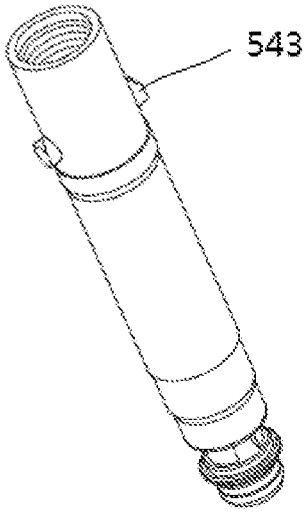
FIG. 21*b* shows a perspective view of the first piston rod shown in FIG. 21*a*.

At least one protruding post 543 is formed on an outer peripheral wall of each of the first piston rod 541 and the second piston rod 542, preferably as shown in FIGS. 21*a* and 21*b*, two protruding posts 543 are formed on the outer peripheral wall of each of the first piston rod 541 and the second piston rod 542, and the two protruding posts 543 are configured to be able to mate with the two apertures 532 on either end of the connecting rod 530, respectively.

Figure 22A:
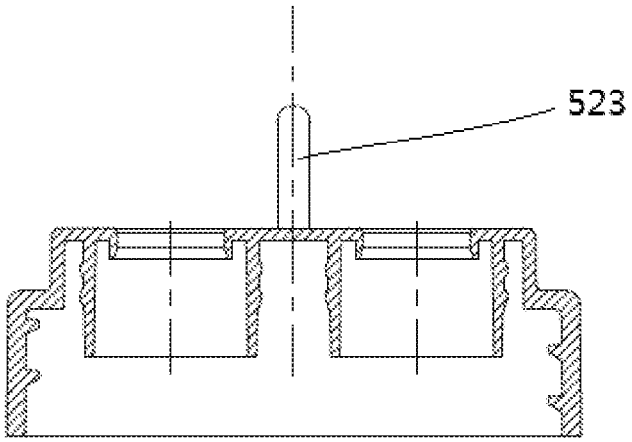
FIG. 22*a* shows a cross-sectional view of a threaded sleeve of the press pump shown in FIG. 18.
Figure 22B:
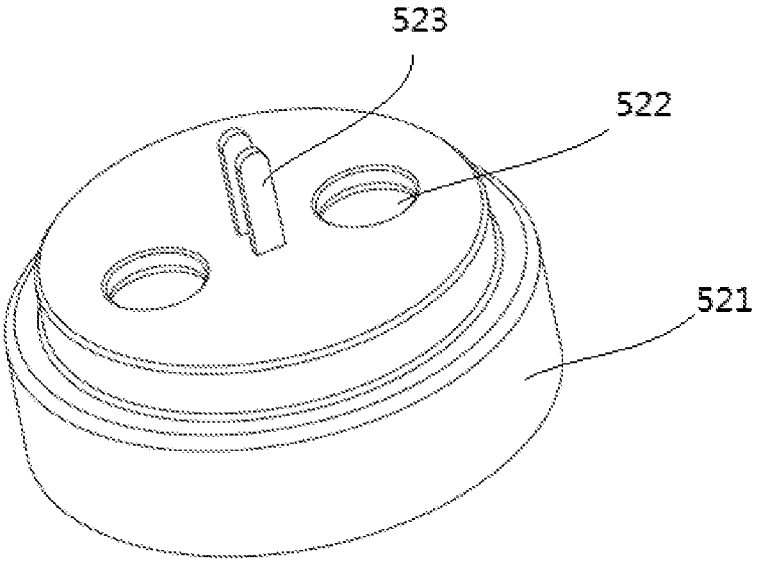
FIG. 22*b* shows a perspective view of the threaded sleeve shown in FIG. 22*a*.

FIGS. 22*a* and 22*b* show the structure of the threaded sleeve 520 of the press pump 500 of the fifth embodiment. The threaded sleeve 520 comprises a threaded sleeve body 521, and two mounting holes 522 are formed in the top of the threaded sleeve body 521 for mounting the first pressing head 511 and the second pressing head 512, respectively. A support rod 523 is provided between the two mounting holes 522, and the shape of the support rod 523, particularly the shape of the top of the support rod 523 matches the shape of the pivoting portion 531 of the connecting rod 530, such that the pivoting portion 531 can be borne on the support rod 523, and the connecting rod 530 can pivot about the pivoting portion 531.

In order to enable the support rod 523 to stably support the pivoting portion 531 of the connecting rod 530, it is preferable to provide two support rods 523 spaced apart from each other at a certain distance on the threaded sleeve 520, as shown in FIG. 22*b*. Alternatively, the support rod 523 may be configured to have a certain thickness to meet the requirements of stably supporting the connecting rod 530.

The operation principle of the press pump 500 of the fifth embodiment will be described below.

When a product needs to be dispensed from a dual-chamber container, one of the two pressing heads is pressed down first, for example, the first pressing head 511 is pressed down first. As the first pressing head 511 moves downward, the first piston rod 541 connected to the first pressing head 511 also moves downward, driving the end of the connecting rod 530 on the side connected to the first pressing head 511 to move downward. At this time, the connecting rod 530 pivots about the pivoting portion 531 under the support action of the support rod 523, such that the other end of the connecting rod 530 on the side connected to the second pressing head 512 moves upward, thereby moving the second pressing head 512 and the second piston rod 542 connected to the second pressing head 512 upward. When the first pressing head 511 reaches a lower dead point of a stroke thereof, the second pressing head 512 also reaches an upper dead point of a stroke thereof, thereby restoring the second pressing head 512.

Next, the user can press the second pressing head 512 to obtain the product from the other chamber of the container. As the second pressing head 512 moves downward, the connecting rod 530 pivots about the pivoting portion 531 in the opposite direction to that when the first pressing head 511 was previously depressed, thereby moving the first pressing head 511 upward. In this way, when the second pressing head 512 reaches a lower dead point of the stroke thereof, the first pressing head 511 reaches an upper dead point of the stroke thereof, thereby restoring the first pressing head 511.

Sixth Embodiment

FIGS. 23*a* to 28*b* show a press pump 600 of a sixth embodiment of the present invention. In the following description of the sixth embodiment, for the sake of brevity, the features that are not included in the first to fifth embodiments are mainly described, and the same technical features as those of the first to fifth embodiments will not be described in detail.

The press pump 600 of the sixth embodiment is also a dual-body pump, comprising a threaded sleeve 620, and a first pressing head 611 and a second pressing head 612 mounted on the threaded sleeve 620. A first piston rod 641 is connected to the first pressing head 611, and a second piston rod 642 is connected to the second pressing head 612.

Figure 23A:
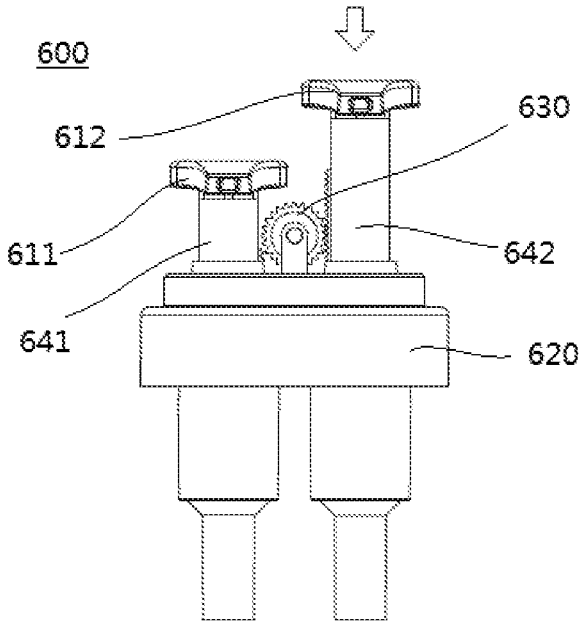
FIG. 23*a* shows a front view of a pump of a sixth embodiment of the present invention, the pump being in the form of a dual-body press pump.
Figure 23B:
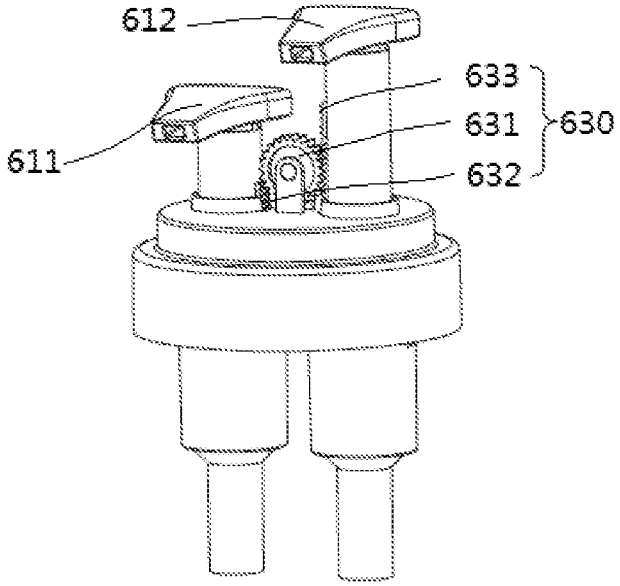
FIG. 23*b* shows a perspective view of the press pump shown in FIG. 23*a*.
Figure 24:
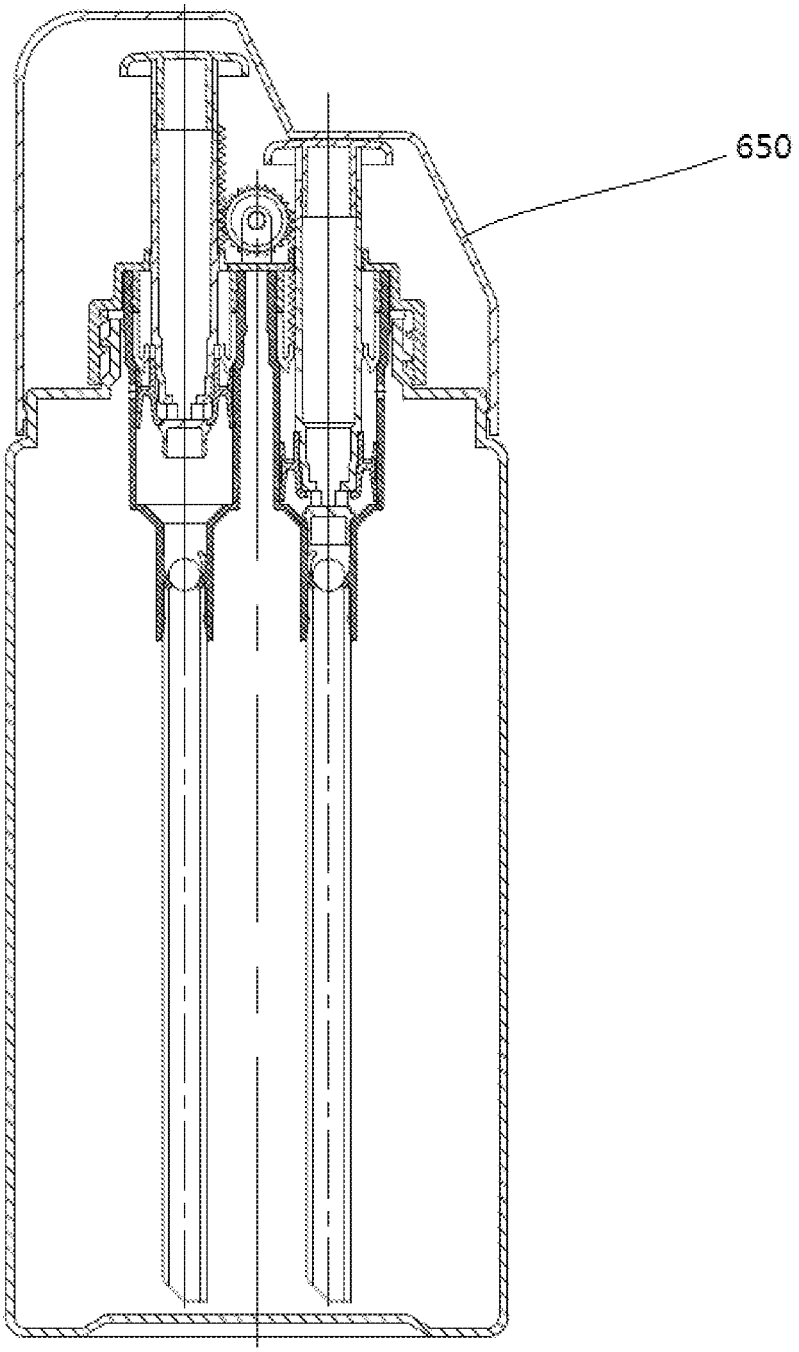
FIG. 24 shows a cross-sectional view of the press pump of the sixth embodiment shown in FIG. 23*a* when mounted in a corresponding dual-chamber container.
Figure 25A:
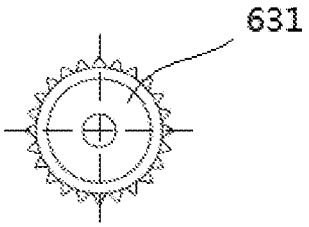
FIGS. 25*a* to 25*c* show a front view, a cross-sectional view and a perspective view of a gear used in the press pump of the sixth embodiment.
Figure 25B:
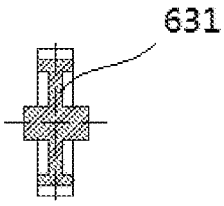
Figure 25C:
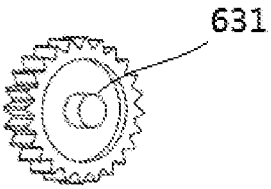
Figure 26A:
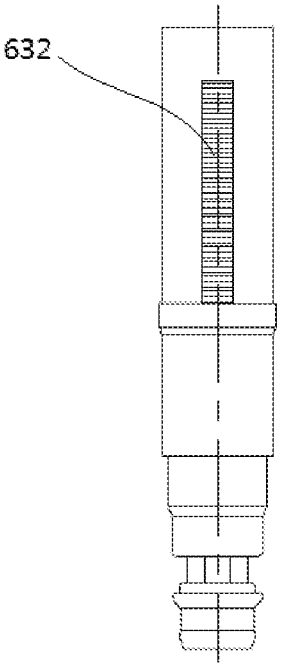
FIGS. 26*a* to 26*c* show a front view, a cross-sectional view and a perspective view of a first piston rod of the press pump of the sixth embodiment.
Figure 26B:
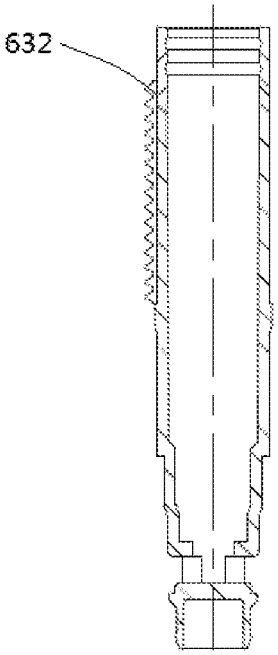
Figure 26C:
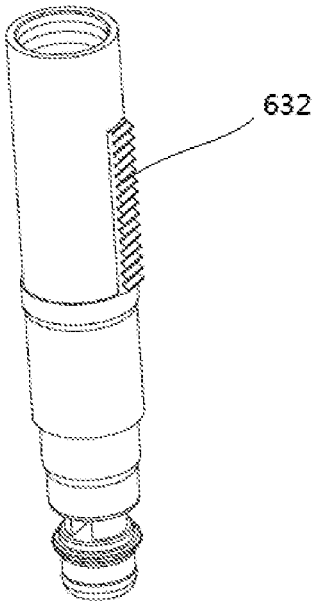

Different from the previous embodiments, the press pump 600 of the sixth embodiment is provided with a gear train 630 as a linkage device between the first pressing head 611 and the second pressing head 612. Specifically, as shown in FIGS. 23*a* to 24, the gear train 630 comprises a gear 631. The gear 631 is mounted on a gear mounting portion 623 provided at the top of a threaded sleeve body 621 of the threaded sleeve 620 (see FIGS. 28*a* and 28*b*).

The gear train 630 further comprises a first rack 632 formed on the first piston rod 641 and a second rack 633 formed on the second piston rod 642. The structure of the first piston rod 641 is shown as an example in FIGS. 26*a* to 26*c*, and the structure of the second piston rod 642 is basically the same as the first piston rod 641. The first rack 632 and the second rack 633 are arranged such that, in a mounted state, the first rack 632 and the second rack 633 mesh with the gear 631 on two sides of the gear 631, as shown in FIGS. 23*a* and 23*b*.

Figure 28A:
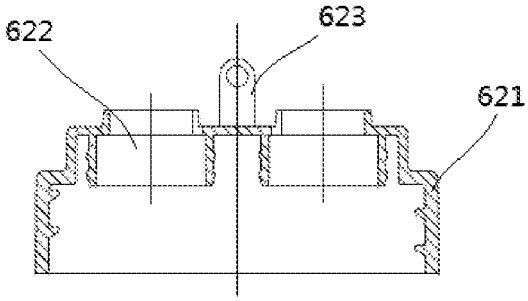
FIG. 28*a* shows a cross-sectional view of a threaded sleeve of the press pump of the sixth embodiment.
Figure 28B:
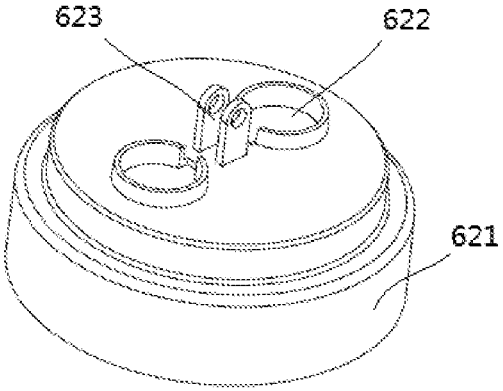
FIG. 28*b* shows a perspective view of the threaded sleeve shown in FIG. 28*a*.

FIGS. 28*a* and 28*b* show the structure of the threaded sleeve 620, wherein the top of the threaded sleeve body 621 of the threaded sleeve 620 is provided with two mounting holes 622 for receiving the first pressing head 611 and the second pressing head 612, respectively. A gear mounting portion 623 is provided between the two mounting holes 622, and the gear 631 is rotatably mounted on the gear mounting portion 623.

Figure 27A:
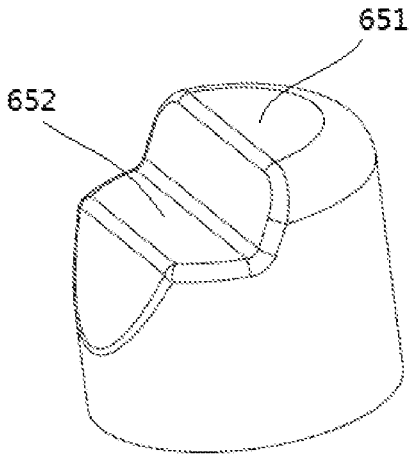
FIG. 27*a* shows a perspective view of a pump housing of the container shown in FIG. 24.
Figure 27B:
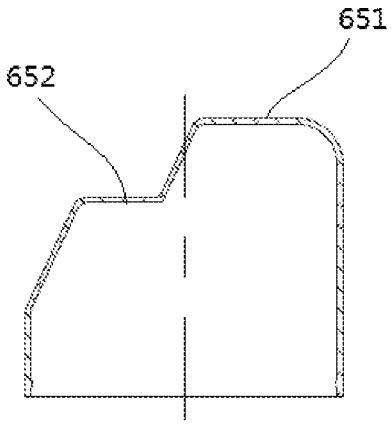
FIG. 27*b* shows a cross-sectional view of the pump housing shown in FIG. 27*a*.

In the sixth embodiment of the present invention, preferably, further comprised is a pump housing 650 for covering the press pump 600. The pump housing 650 functions to protect the press pump 600 during processes such as transportation and storage. FIGS. 27*a* and 27*b* show the specific structure of the pump housing 650. It can be seen from the figures that the pump housing 650 is preferably substantially stepped, with the top thereof having a higher top face 651 and a lower top face 652. The height of the higher top face 651 corresponds to an upper dead point of a stroke of one of the first pressing head 611 and the second pressing head 612, and the height of the lower top face 652 corresponds to a lower dead point of a stroke of the other of the first pressing head 611 and the second pressing head 612. In this way, when the pump housing 650 is pressed against the container to cover the press pump 600, one of the first pressing head 611 and the second pressing head 612 can be fixed to the upper dead point, and the other of the first pressing head 611 and the second pressing head 612 can be fixed to the lower dead point. In this way, in combination with the design of upper and lower seals of the press pump 600 in the prior art, the press pump 600 can be kept locked and sealed to avoid leakage of the product during transportation and storage.

The operation principle of the press pump 600 of the sixth embodiment will be described below.

During use, the user presses one of the first pressing head 611 and the second pressing head 612. For example, the first pressing head 611 is pressed to move the first pressing head 611 downward, and in turn the first piston rod 641 connected to the first pressing head 611 also moves downward. In this process, the first rack 632 on the first piston rod 641 meshes with the gear 631 to rotate the gear 631, and the rotation of the gear 631 in turn causes the second piston rod 642 and the second pressing head 612 to move upward by means of the meshing between the gear 631 and the second rack 633 on the second piston rod 642. When the first pressing head 611 is pressed to the lower dead point of the stroke thereof, the second pressing head 612 reaches the upper dead point of the stroke thereof, thereby restoring the second pressing head 612.

Next, the user can press the other of the first pressing head 611 and the second pressing head 612, for example, pressing the second pressing head 612, such that the second pressing head 612 and the second piston rod 642 connected to the second pressing head 612 move downward. By means of the meshing between the second rack 633 on the second piston rod 642 and the gear 631 and the meshing between the gear 631 and the first rack 632 on the first piston rod 641, the downward movement of the second pressing head 612 and the second piston rod 642 is transformed into the upward movement of the first pressing head 611 and the first piston rod 641. When the second pressing head 612 reaches the lower dead point of the stroke thereof, the first pressing head 611 reaches an upper dead point of the stroke thereof, thereby restoring the first pressing head 611.

Seventh Embodiment

FIGS. 29 to 35*b* show a press pump 700 of a seventh embodiment of the present invention, and two press pumps 700' and 700" having variant structures of the seventh embodiment. In the following description of the seventh embodiment, for the sake of brevity, the features that are not included in the first to sixth embodiments are mainly described, and the same technical features as those of the first to sixth embodiments will not be described in detail.

Figure 29:
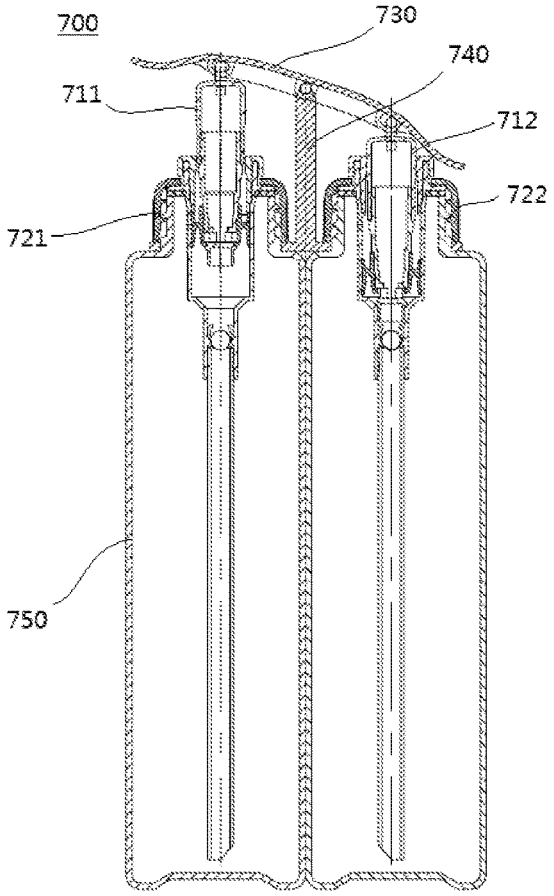
FIG. 29 shows a cross-sectional view of a pump of a seventh embodiment of the present invention, with a fulcrum portion being clamped between a threaded sleeve and a container.

The press pump 700 of the seventh embodiment shown in FIG. 29 is in the form of a dual-body press pump, comprising a first pressing head 711 and a second pressing head 712. Different from the previous embodiments of the dual-body press pumps, in the seventh embodiment, two independent threaded sleeves are comprised, to replace the integral threaded sleeve. As shown in the figures, the first pressing head 711 is mounted on a first threaded sleeve 721, and the second pressing head 712 is mounted on a second threaded sleeve 722. Correspondingly, two connection necks are provided on the container 750, which are respectively used to mount the first threaded sleeve 721 and the second threaded sleeve 722.

Figure 30:
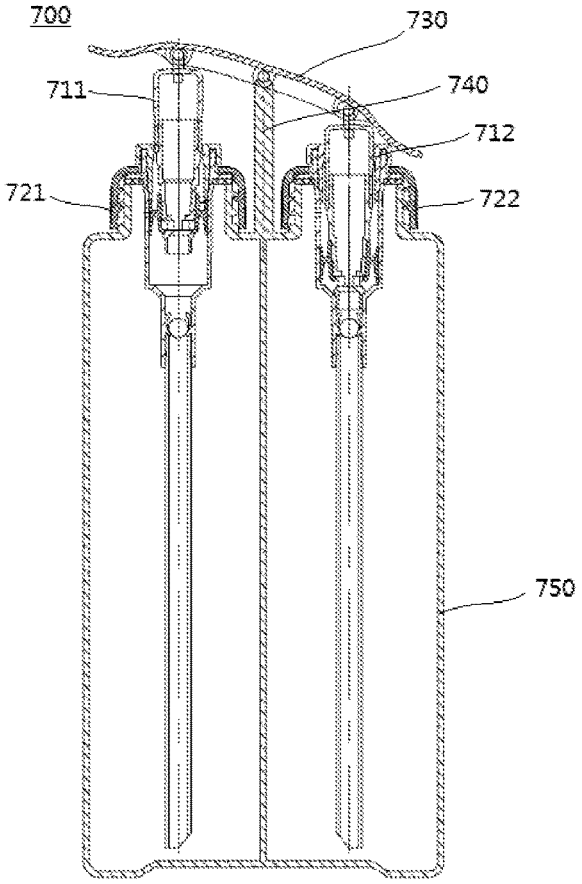
FIG. 30 shows a cross-sectional view of another form of the pump of the seventh embodiment, with the fulcrum portion being formed on the container.

Further, in the press pump 700 shown in FIG. 29, a fulcrum portion 740 for supporting a pressing plate 730 to enable the pivoting movement of the pressing plate 730 is not directly formed on the threaded sleeve, but is clamped between the first threaded sleeve 721, the second threaded sleeve 722 and the container 750. Alternatively, the fulcrum portion 740 may also be integrally formed on the container 750, as shown in FIG. 30.

Figure 31:
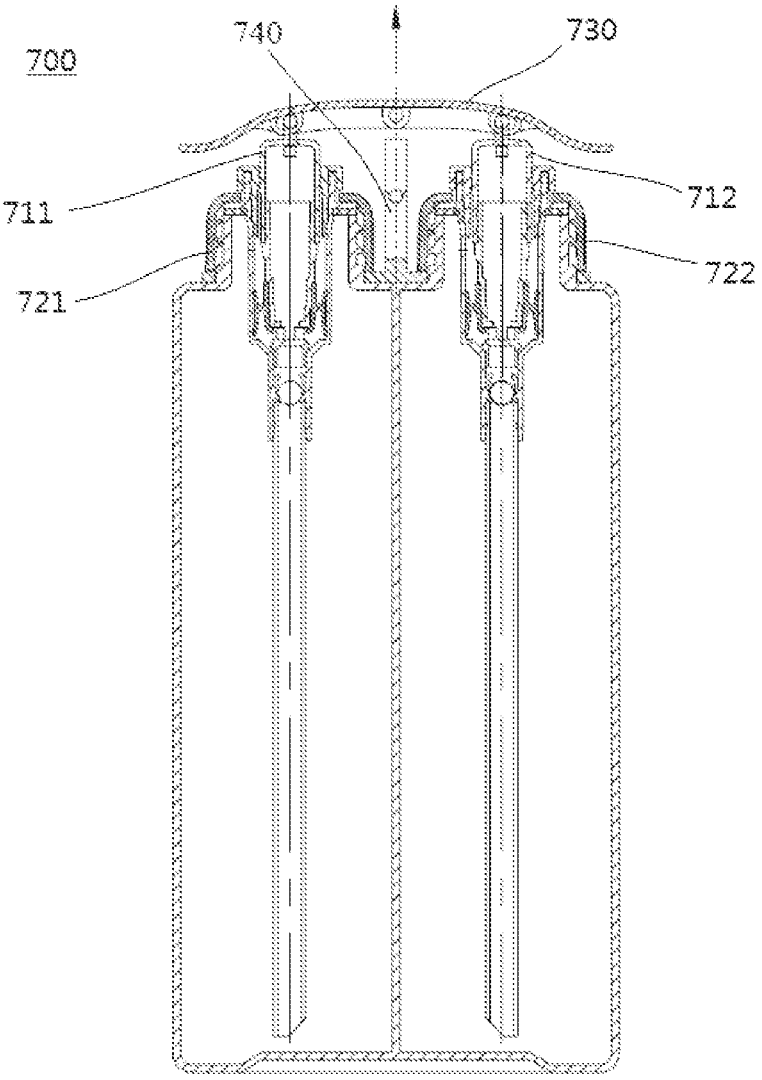
FIG. 31 shows a cross-sectional view of yet another form of the pump of the seventh embodiment, with the fulcrum portion being in a foldable form.
Figure 32A:
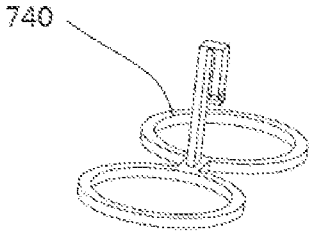
FIG. 32*a* shows a perspective view of the foldable fulcrum portion of the pump shown in FIG. 31.
Figure 32B:
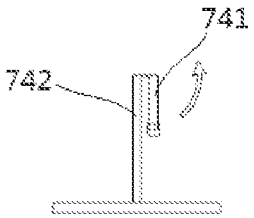
FIG. 32*b* shows a front view of the fulcrum portion shown in FIG. 32, with the fulcrum portion being in a folded state.
Figure 32C:
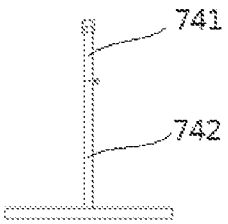
FIG. 32*c* shows another front view of the fulcrum portion shown in FIG. 32, with the fulcrum portion being in an unfolded state.

The fulcrum portion 740 may also be formed in a foldable structure, as shown in FIGS. 31 to 32*b*. FIGS. 32*a* to 32*c* show a perspective view, a front view in a folded state, and a front view in an unfolded state of the fulcrum portion 740, respectively.

As shown in FIGS. 32*a* to 32*c*, a rod part of the fulcrum portion 740 comprises a first segment 741 and a second segment 742. The first segment 741 can move between a first position in which the first segment 741 is folded on the second segment 742 (FIG. 32*b*), and a second position in which the first segment 741 is unfolded and forms a straight line with the second segment 742 (FIG. 32*c*).

For the fulcrum portion 740 of the foldable form, when the product container is transported, the first segment 741 may be placed in the first position, such that the fulcrum portion 740 is in the folded state, and the first pressing head 711 and the second pressing head 712 of the press pump 700 are both in a lower-position state (see FIG. 31), thereby facilitating storage and transportation. When using for the first time, the user can manually pull the first pressing head 711 and the second pressing head 712 up, and pivot the first segment 741 to the second position, such that the fulcrum portion 740 is transformed into the unfolded state, and supports the pivoting portion of the pressing plate 730, for example, the fulcrum portion 740 can be snapped to the pivoting portion of the pressing plate 730, and the press pump 700 can then be pressed for use.

It should be noted that the fulcrum portion 740 of the above foldable configuration may also be used in the case of the integral threaded sleeve such as in the third embodiment.

Figure 33:
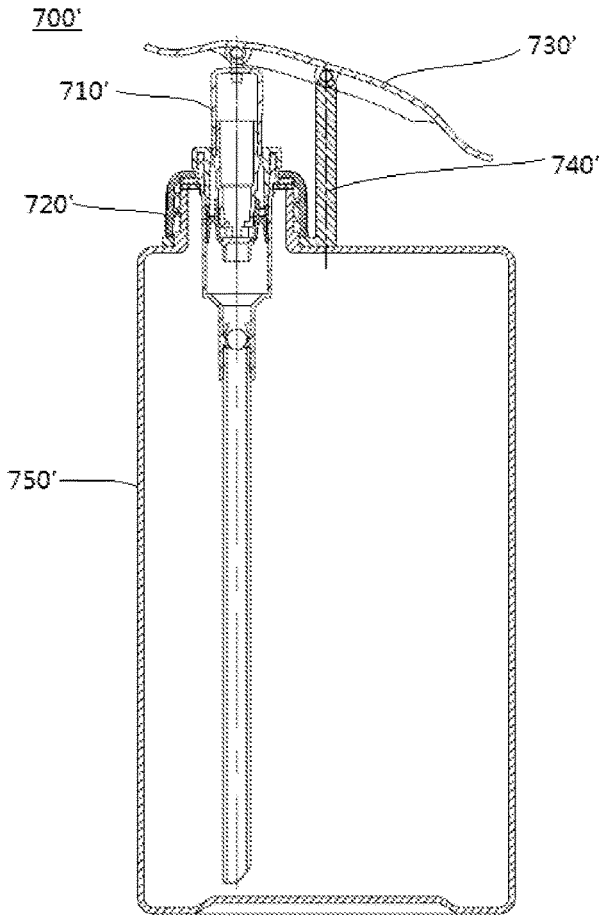
FIG. 33 shows a cross-sectional view of a variant structure of the pump of the seventh embodiment, with the pump being a single-body pump, and the fulcrum portion being clamped between the threaded sleeve and the container.
Figure 34:
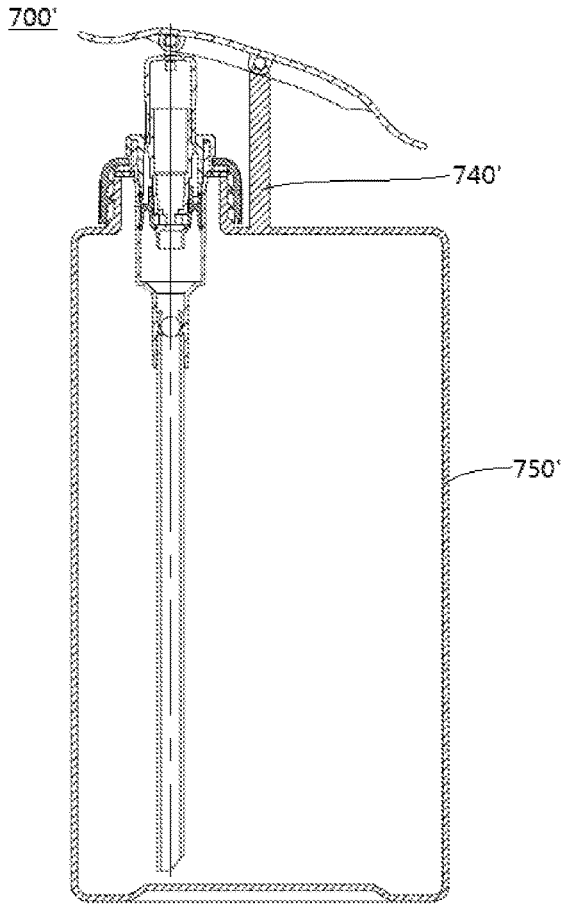
FIG. 34 shows another form of the pump shown in FIG. 33, with the fulcrum portion being formed on the container.

FIGS. 33 and 34 show a variant structure based on the seventh embodiment. As shown in FIG. 33, the press pump 700' is in the form of a single-body pump, comprising a pressing head 710' and a threaded sleeve 720'. A pressing plate 730' is mounted on the pressing head 710'. In addition, a fulcrum portion 740' is clamped and fixed between the threaded sleeve 720' and a container 750', and an upper end of the fulcrum portion 740' is connected to a pivoting portion of the pressing plate 730', allowing the pressing plate 730' to pivot.

Alternatively, the fulcrum portion 740' may also be integrally formed on the container 750', as shown in FIG. 34.

Figure 35A:
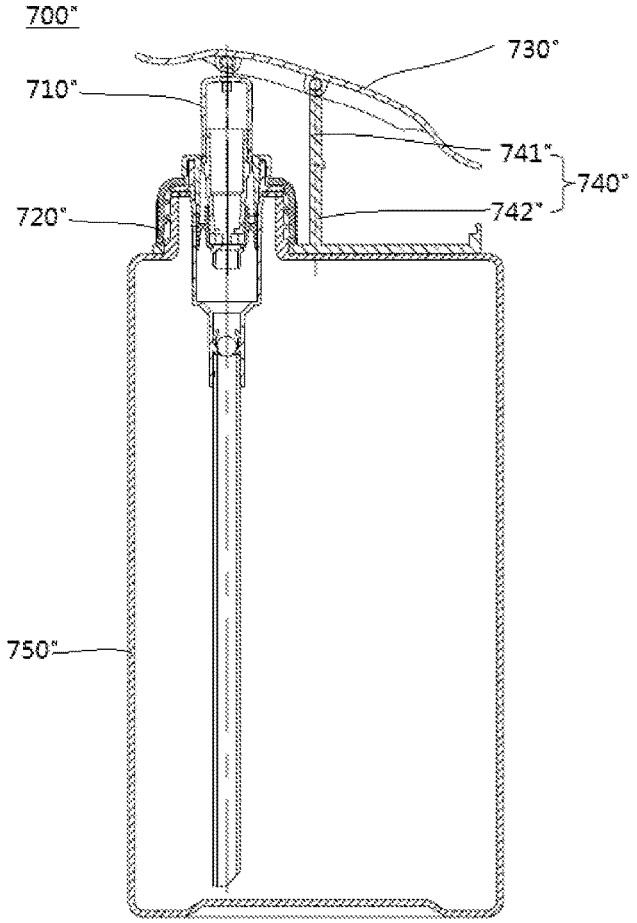
FIG. 35*a* shows a cross-sectional view of another variant structure of the pump of the seventh embodiment, with the pump being a single-body pump, and the fulcrum portion being foldable and being in an unfolded state.
Figure 35B:
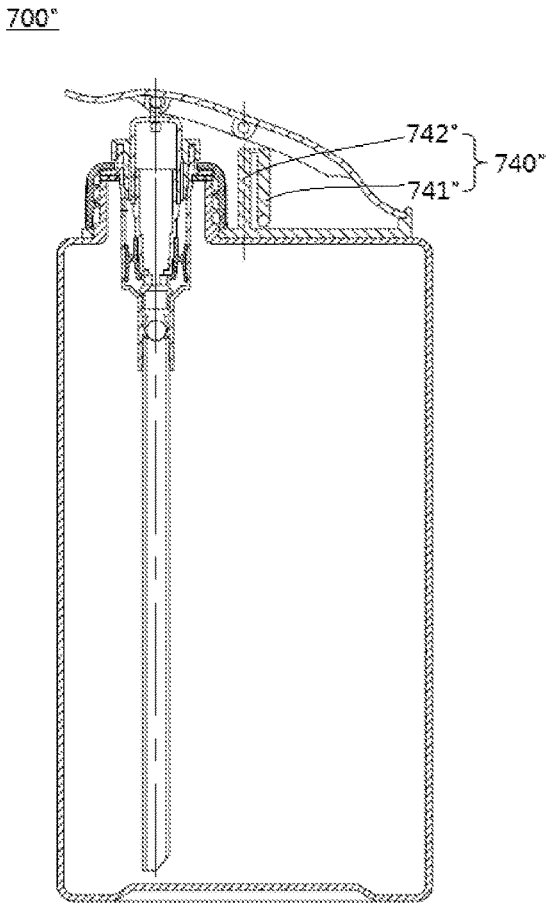
FIG. 35*b* is another cross-sectional view of the pump shown in FIG. 35*a*, with the fulcrum portion being in a folded state.

FIGS. 35*a* and 35*b* show another variant structure based on the seventh embodiment. As shown in FIGS. 35*a* and 35*b*, the press pump 700" is also in the form of a single-body pump, comprising a pressing head 710" and a threaded sleeve 720". The fulcrum portion 740" is clamped between the threaded sleeve 720" and a container 750", and a rod part of the fulcrum portion 740" is foldable, and comprises a first segment 741" and a second segment 742". During transportation or storage, the fulcrum portion 740" is in a folded state, and the pressing head 710" is in a depressed position at this time, which facilitates storage and transportation (FIG. 35*b*). When used for the first time, the fulcrum portion 740" is set to be in an unfolded state, and is connected to a pivoting portion of the pressing plate 730", allowing the pressing plate 730" to pivot.

Of course, the fulcrum portion 740" of the press pump 700" shown in FIGS. 35*a* and 35*b* may also be integrally formed on the container 750".

Eighth Embodiment

FIGS. 36*a* to 37*b* show a press pump 800 of an eighth embodiment of the present invention. In the following description of the eighth embodiment, for the sake of brevity, the features that are not included in the first to seventh embodiments are mainly described, and the same technical features as those of the first to seventh embodiments will not be described in detail.

Figure 36A:
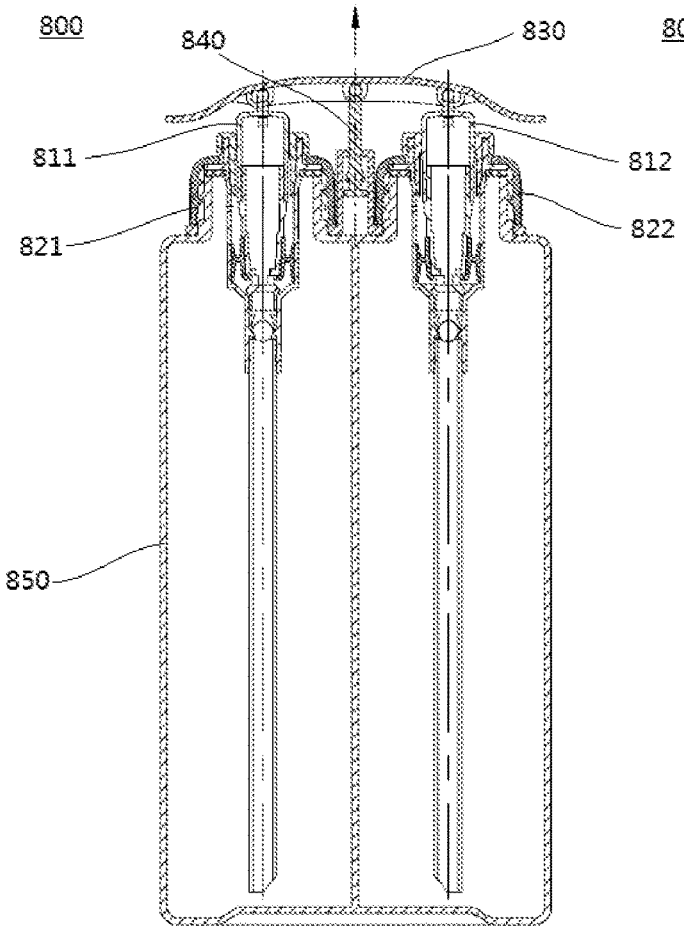
FIG. 36*a* shows a cross-sectional view of a pump of an eighth embodiment of the present invention, with the fulcrum portion being telescopic and being in a retracted state.
Figure 36B:
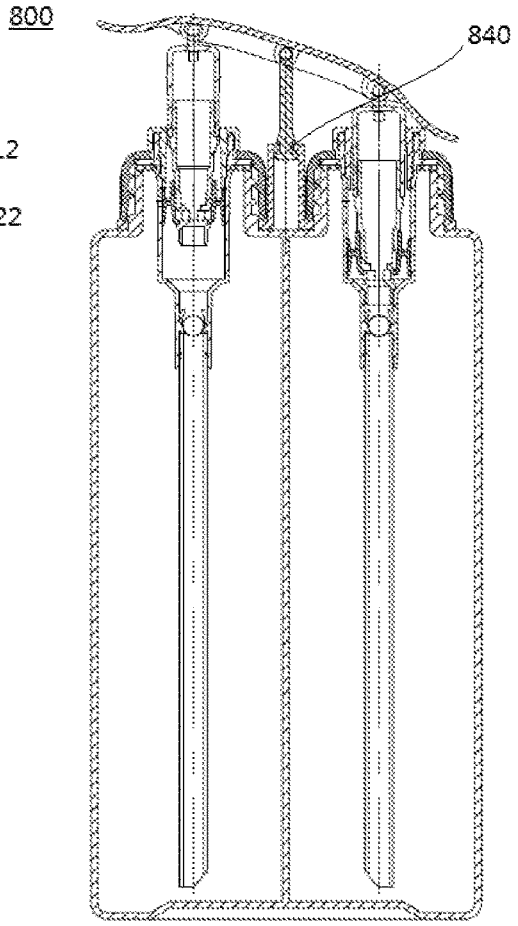
FIG. 36*b* is another cross-sectional view of the pump of the eighth embodiment of the present invention, with the fulcrum portion being in an extended state.
Figure 37A:
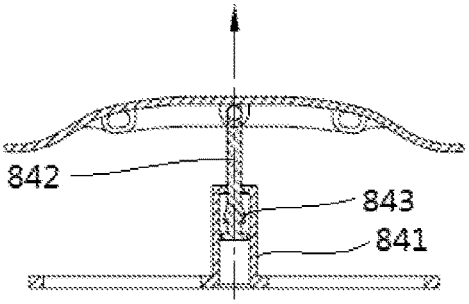
FIGS. 37*a* and 37*b* show the fulcrum portion in the retracted state and the extended state, respectively.
Figure 37B:
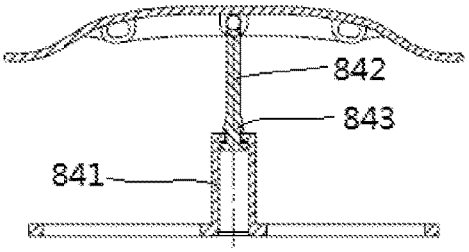

As shown in FIGS. 36*a* and 36*b*, the press pump 800 is in the form of a dual-body pump, comprising a first pressing head 811 and a second pressing head 812. The first pressing head 811 is connected to a first threaded sleeve 821, and the second pressing head 812 is connected to a second threaded sleeve 822. Two necks are provided on a container 850 on which the press pump 800 is mounted, which are respectively used to mount the first threaded sleeve 821 and the second threaded sleeve 822. A pressing plate 830 is connected to the first pressing head 811 and the second pressing head 812. The pressing plate 830 is supported on a fulcrum portion 840 and can pivot about an apex of the fulcrum portion 840. The fulcrum portion 840 is clamped and fixed between the first threaded sleeve 821, the second threaded sleeve 822 and the container 850.

In the eighth embodiment, the fulcrum portion 840 has a unidirectionally telescopic structure. The unidirectionally telescopic structure can be specifically referred to FIGS. 37*a* and 37*b*. The fulcrum portion 840 comprises a sleeve 841 and a ratcheted rod 842. One end of the ratcheted rod 842 is connected to the pressing plate 830, and the other end thereof comprises a ratchet 843, and is slidably accommodated in the sleeve 841. During storage and transportation, the ratcheted rod 842 is retracted into the sleeve 841, thereby allowing the first pressing head 811 and the second pressing head 812 of the press pump 800 to be in a depressed position shown in FIG. 36*a*. When using for the first time, the user can pull the pressing plate 830 upward, such that the ratcheted rod 842 also moves upward along therewith, until the ratchet 843 of the ratcheted rod 842 passes over the top of the sleeve 841 and is snapped onto the top of the sleeve 841. Due to the action of the ratchet, the ratcheted rod 842 is prevented from returning downward, such that the fulcrum portion 840 is fixed in an extended state, and the user can now press and use the lotion pump normally.

It is to be noted here that the fulcrum portion 840 of the above telescopic structure may also be used in the case of the integral threaded sleeve such as in the third embodiment.

Ninth Embodiment

FIGS. 38*a* to 40*d* show a press pump 900 of a ninth embodiment of the present invention. In the following description of the ninth embodiment, for the sake of brevity, the features that are not included in the first to eighth embodiments are mainly described, and the same technical features as those of the first to eighth embodiments will not be described in detail.

Figure 38A:
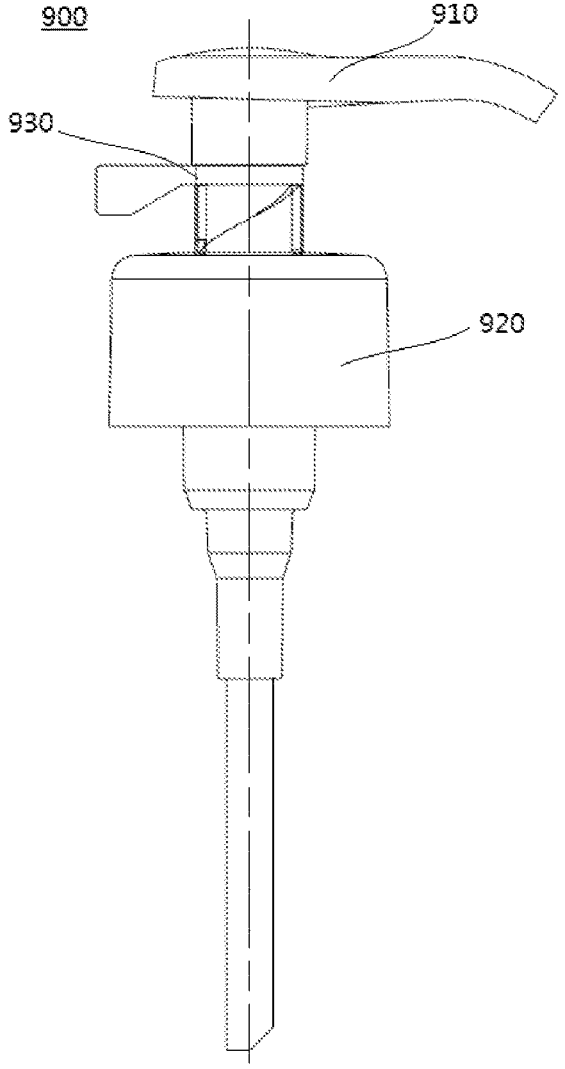
FIG. 38*a* shows a side view of a pump of a ninth embodiment of the present invention, with the pump being in a depressed state.
Figure 38B:
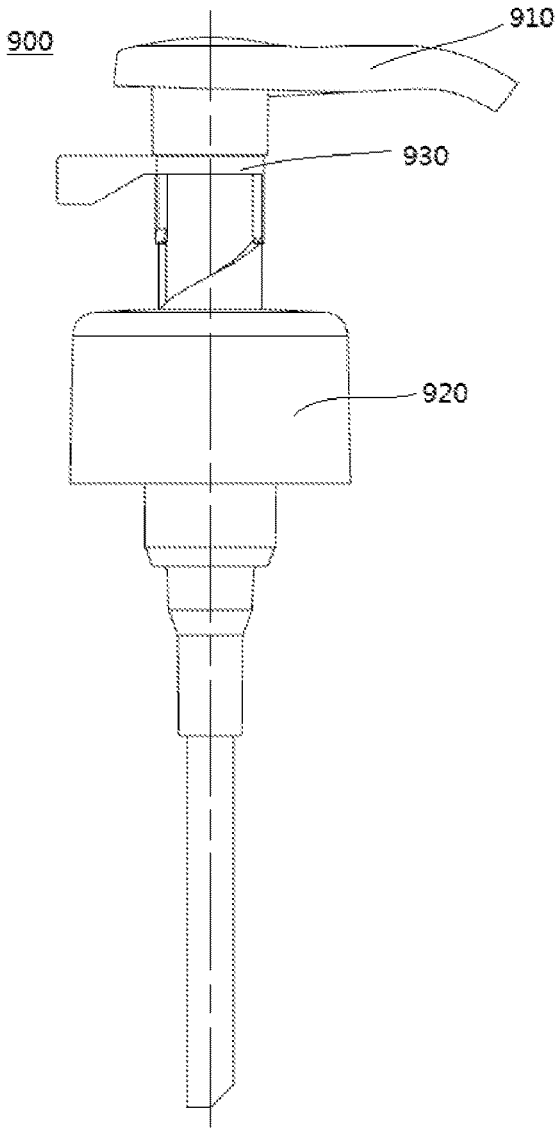
FIG. 38*b* shows another side view of the pump shown in FIG. 38*a*, with the pump being in a restored state.

As shown in FIGS. 38*a* and 38*b*, the press pump 900 of the ninth embodiment comprises a pressing head 910. The pressing head 910 is mounted on a threaded sleeve 920, and a rotary restoring member 930 is provided between the pressing head 910 and the threaded sleeve 920.

Figure 39A:
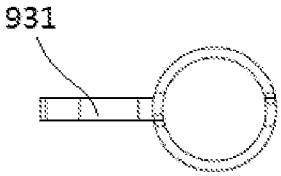
FIGS. 39*a* to 39*c* are a top view, a side view and a perspective view of a rotary restoring member of the pump of the ninth embodiment, respectively.
Figure 39B:
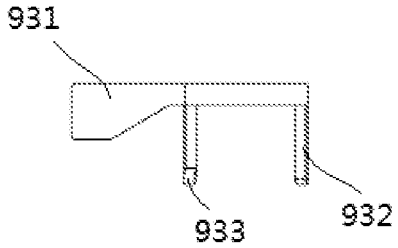
Figure 39C:
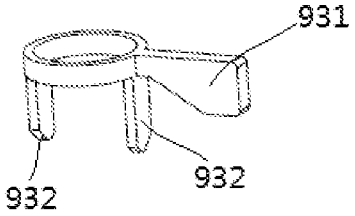
Figure 40A:
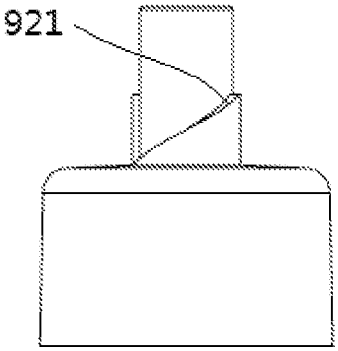
FIG. 40*a* is a side view of a threaded sleeve of the pump of the ninth embodiment.
Figure 40B:
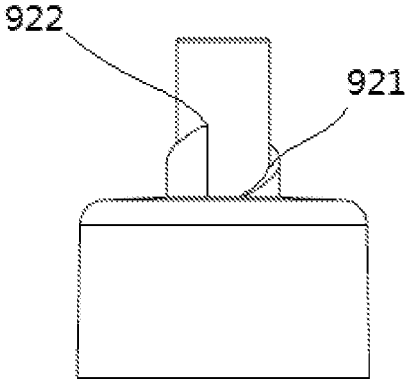
FIG. 40*b* is another side view of the threaded sleeve shown in FIG. 40*a*.
Figure 40C:
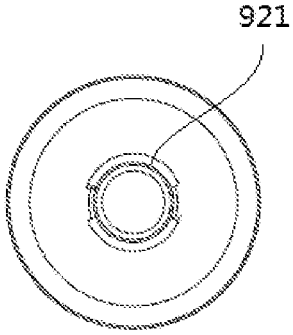
FIG. 40*c* is a top view of the threaded sleeve shown in FIG. 40*a*.
Figure 40D:
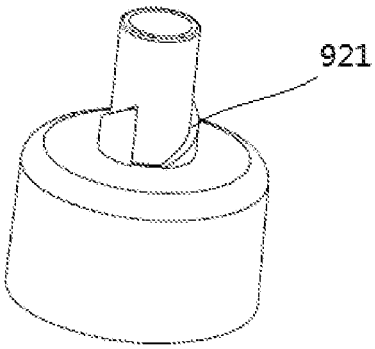
FIG. 40*d* is a perspective view of the threaded sleeve shown in FIG. 40*a*.

FIGS. 39*a* to 39*c* show various views of the rotary restoring member 930. It can be seen from the figures that the rotary restoring member 930 comprises an operation portion 931 and at least one (two shown in the figures) abutment portion 932 suspended downward from a body of the rotary restoring member 930, and a slope 933 is formed on a free end of the abutment portion 932.

Correspondingly, as shown in FIGS. 40*a* to 40*d*, a mating slope 921 is formed on a neck of the threaded sleeve 920, and the mating slope 921 matches the slope 933 on the abutment portion 932 of the rotary restoring member 930 in shape.

When the user presses the pressing head 910 of the press pump 900, the pressing head 910 moves downward, and the rotary restoring member 930 also moves downward along with the pressing head 910. At the same time, due to the mating between the slope 933 and the mating slope 921, the rotary restoring member 930 is guided to rotate in one direction. After the product in the container is dispensed once, the user can operate the operation portion 931 of the rotary restoring member 930 to rotate the operation portion 931 in the opposite direction. At this time, under the effect of the mating between the slope 933 and the mating slope 921, the rotary restoring member 930 moves upward, and the pressing head 910 is in turn lifted upward, thereby restoring the pressing head 910.

Alternatively, the rotary restoring member 930 may also be arranged such that when the rotary restoring member 930 is rotated to restore the pressing head 910, the rotary restoring member 930 can be rotated such that the abutment portion 932 thereof passes over the highest point 922 of the slope 933 of the threaded sleeve 920 before stopping. In this way, the next time the pressing head 910 is pressed, the rotary restoring member 930 does not rotate, but directly moves downward along with the pressing head 910. Then, the rotary restoring member 930 is rotated in the same direction as before, to restore the pressing head 910. In other words, in this case, the rotary restoring member 930. In this case, the inner diameter of the rotary restoring member 930 may be set to be larger than the outer diameter of the neck of the threaded sleeve 920. At this time, during the restoring operation, after the abutment portion 932 of the rotary restoring member 930 passes over the highest point 922 of the slope 933, the rotary restoring member 930 automatically falls to a lower position thereof.

Tenth Embodiment

Figure 41A:
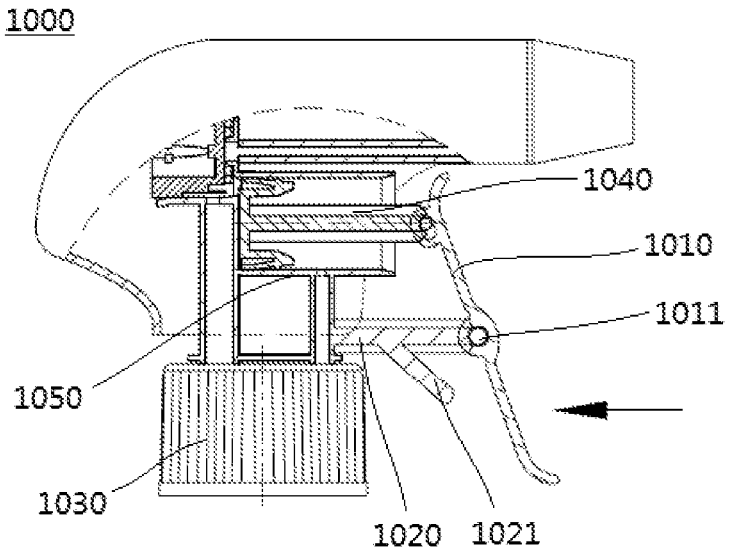
FIG. 41*a* shows a partially cut-away side view of a pump of a tenth embodiment of the present invention, with the pump being a hand-triggered pump and being in a pumping state.
Figure 41B:
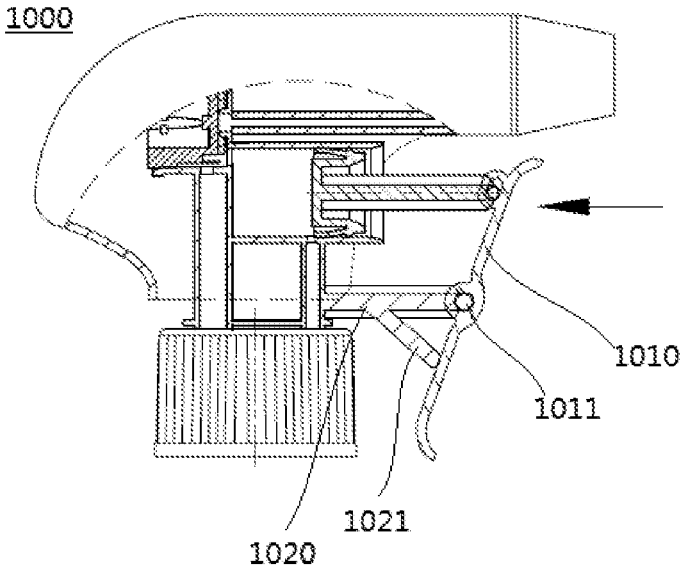
FIG. 41*b* is another partially cut-away side view of the pump shown in FIG. 41*a*, with the pump being in a restored state.
Figure 42:
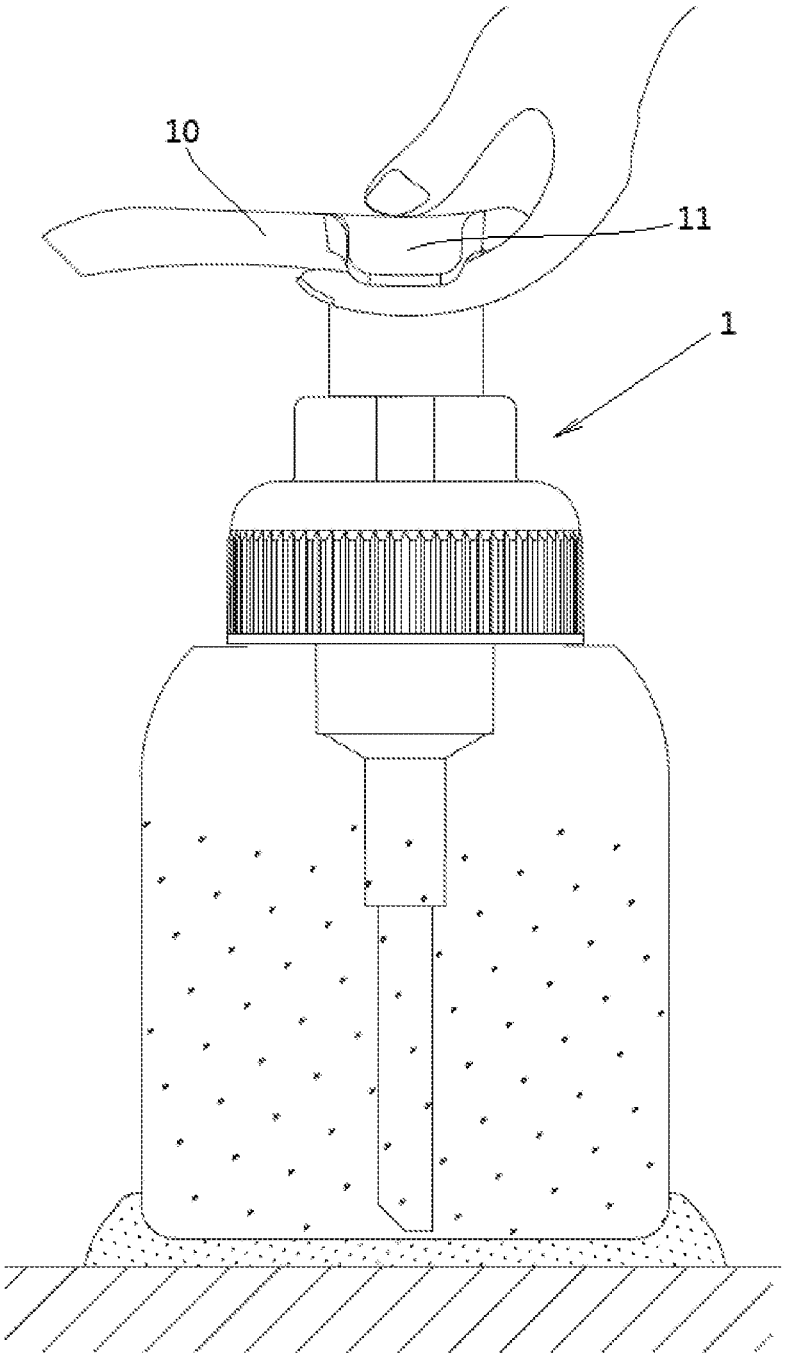
FIG. 42 shows a side view of a pump of the prior art in the form of a press pump and a container on which the press pump is mounted.
Figure 43A:
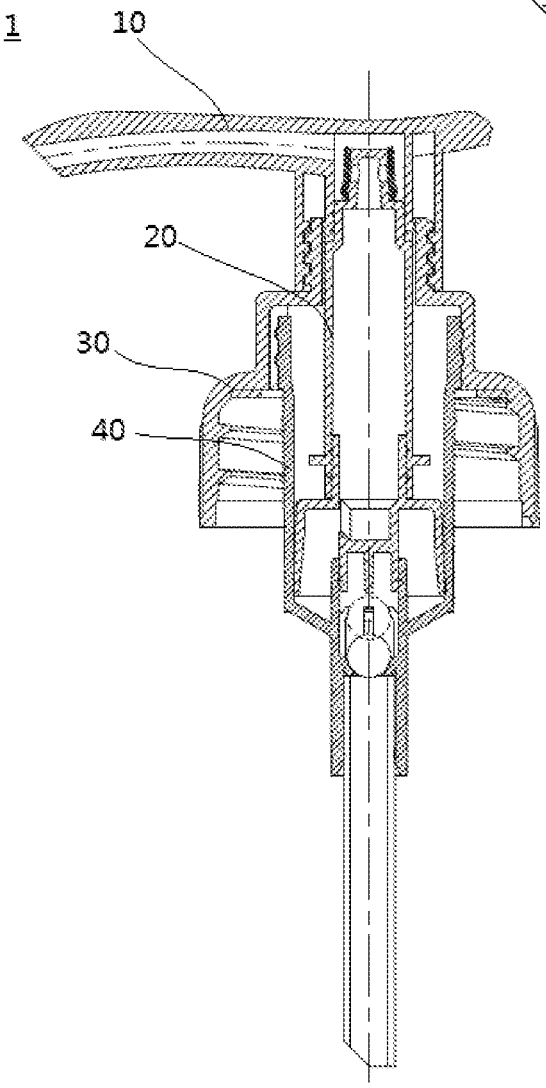
FIG. 43*a* shows a cross-sectional view of the press pump shown in FIG. 42, with the press pump being in a depressed state.
Figure 43B:
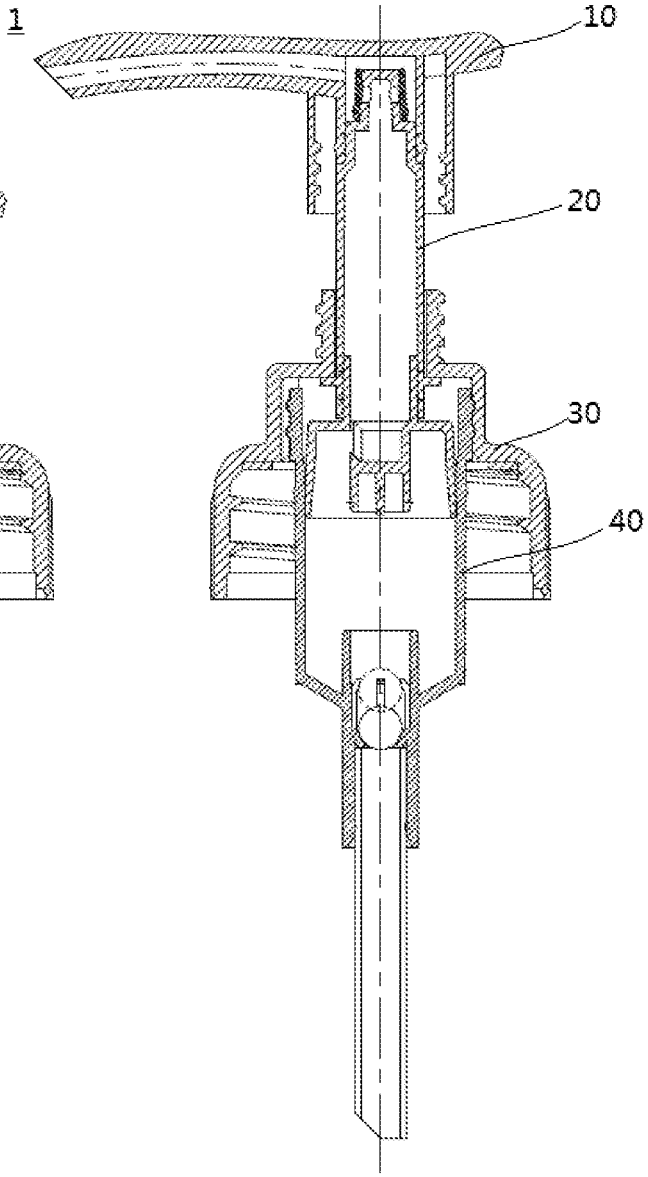
FIG. 43*b* shows another cross-sectional view of the press pump shown in FIG. 42, with the press pump being in a restored state.
Figure 44A:
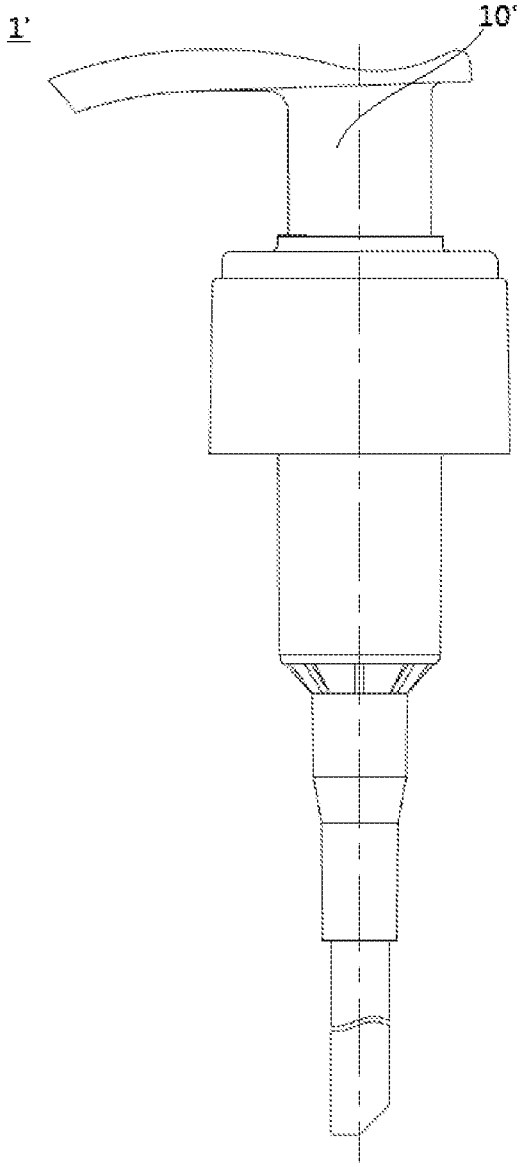
FIG. 44*a* shows a side view of another pump of the prior art in the form of a press pump.
Figure 44B:
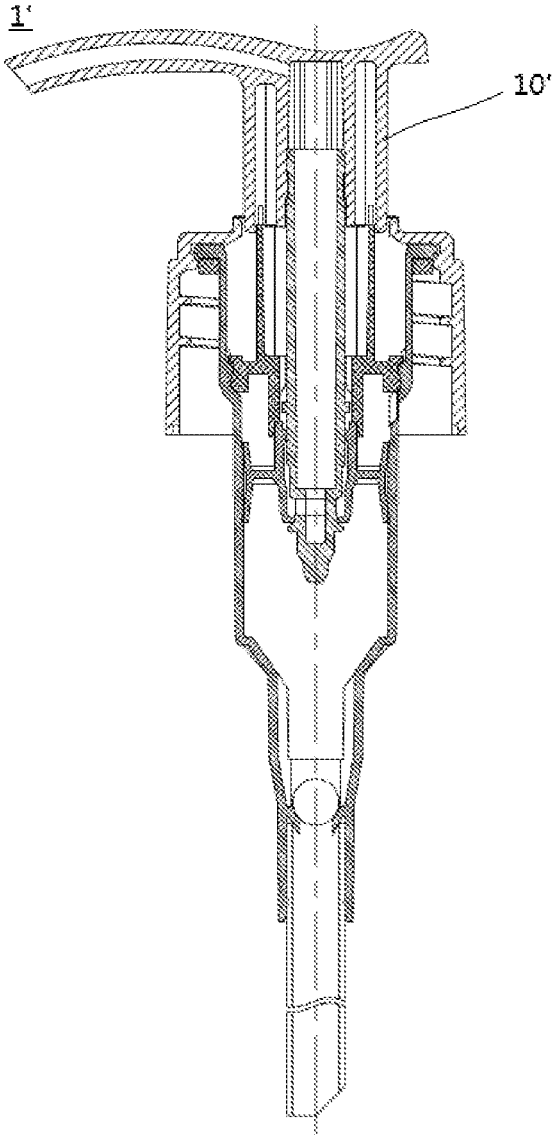
FIG. 44*b* shows a cross-sectional view of the press pump shown in FIG. 44*a*.

FIGS. 41*a* and 41*b* show a hand-triggered pump 1000 of a tenth embodiment of the present invention. In the following description of the tenth embodiment, for the sake of brevity, the features that are not included in the first to ninth embodiments are mainly described, and the same technical features as those of the first to ninth embodiments will not be described in detail.

As shown in FIGS. 41*a* and 41*b*, the pump of the tenth embodiment is a hand-triggered pump 1000, comprising a cylinder 1050 extending substantially in a horizontal direction. A piston rod 1040 comprising a piston is reciprocably accommodated in the cylinder 1050. A first end of a trigger 1010 is connected to the piston rod 1040, and a second end thereof is a free end. The hand-triggered pump 1000 is further provided with a fulcrum portion 1020. The fulcrum portion 1020 is fixedly formed on a fixed portion of the hand-triggered pump 1000, for example, can be formed on a threaded sleeve 1030, the cylinder 1050, etc. The trigger 1010 is connected to the fulcrum portion 1020 at an intermediate point 1011 between the first end and the second end, and the trigger 1010 can rotate about the intermediate point 1011.

As shown in FIG. 41*a*, when the user presses a part of the trigger 1010 between the intermediate point 1011 and the first end, the piston rod 1040 slides toward the inside of the cylinder 1050, thereby pumping the product out. Subsequently, if the piston rod 1040 is to be to restored, the user can press a part of the trigger 1010 between the intermediate point 1011 and the second end to pivot the trigger 1010 about the intermediate point 1011, thereby restoring the piston rod 1040, as shown in FIG. 41*b*.

It can be seen that in the tenth embodiment, the trigger 1010 is used to constitute the transmission part of the restoring mechanism, specifically, the part of the trigger 1010 between the intermediate point 1011 and the second end is the transmission part of the restoring mechanism.

Preferably, a limiting member 1021 may also be provided on the fulcrum portion 1020, which is, for example, a part extending obliquely from a main body of the fulcrum portion 1020 shown in FIGS. 41*a* and 41*b*. In the process of restoring the piston rod 1040 of the hand-triggered pump 1000, when the trigger 1010 abuts against the limiting member 1021, the trigger 1010 stops pivoting, and the piston rod 1040 reaches a restored position at this time, waiting for the next pumping of the product.

The invention claimed is:

1. A springless pump mounted on a container and used for pumping a product contained in the container, which springless pump comprises:

a movable part comprising at least one from the group consisting of a pressing head and a piston rod; and a stationary part comprising at least a threaded sleeve, wherein the springless pump further comprises a restoring mechanism, the restoring mechanism comprising: a transmission component connected to the movable part; and a bearing component formed on or fixedly connected to the stationary part, and the transmission component is supported on the bearing component;

wherein the transmission component is rigid, and the movable part is restored by means of operating the transmission component.

2. The springless pump of claim 1, wherein the transmission component is rotatably or pivotably supported on the bearing component.

3. The springless pump of claim 1, wherein the springless pump is a press pump comprising the pressing head and the piston rod, wherein the piston rod is connected to the pressing head, and wherein the transmission component of the restoring mechanism is connected to the pressing head or the piston rod.

4. The springless pump of claim 3, wherein the transmission component comprises a pressing plate, the pressing plate comprising a pressing head mating portion located at one end of the pressing plate and a pressing portion at the other end of the pressing plate, and the pressing head mating portion being engaged with the pressing head; and the bearing component comprises a fulcrum portion, and the pressing plate further comprises a pivoting portion rotatably supported on the fulcrum portion.

5. The springless pump of claim 4, wherein at least one from the group consisting of the pressing head mating portion is in the shape of a fork, and two arms of the fork clamp a neck of the pressing head from two sides; and the stationary part further comprises a cylinder head, and the bearing component further comprises a fixing portion, the fixing portion being ring-shaped and being snapped between the threaded sleeve and the cylinder head.

6. The springless pump of claim 4, wherein the pressing head mating portion is connected to the top of the pressing head.

7. The springless pump of claim 3, wherein the springless press pump is a dual-body pump and comprises two said pressing heads, namely a first pressing head and a second pressing head, and two mounting holes are formed in the top of the threaded sleeve, the first pressing head and the second pressing head being respectively mounted in the mounting holes.

8. The springless pump of claim 7, wherein the transmission component comprises a pressing plate, the pressing plate comprising a pivoting portion and first and second pressing head mating portions located on two sides of the pivoting portion, wherein the first pressing head mating portion is connected to the first pressing head or to a first piston rod connected to the first pressing head, and the second pressing head mating portion is connected to the second pressing head or to a second piston rod connected to the second pressing head; and the bearing component comprises a fulcrum portion formed on the top of the threaded sleeve, wherein the fulcrum portion is located between the two mounting holes, and the pivoting portion of the pressing plate is rotatably mated on the fulcrum portion.

9. The springless press pump of claim 8, wherein support rods are respectively formed on the tops of the first pressing head and the second pressing head, a first connection point is formed at the first pressing head mating portion, the first connection point is connected to the support rod on the first pressing head, a second connection point is formed at the second pressing head mating portion, and the second connection point is connected to the support rod on the second pressing head.

10. The springless pump of claim 8, further comprising a clip snapped, when the springless press pump is not operated, to at least one of the group consisting of a neck of the first pressing head and a neck of the second pressing head to prevent the downward movement of at least one from the group consisting of the first pressing head and the second pressing head.

11. The springless pump of claim 10, wherein the pressing plate is detachable, and the clip is integrated onto the pressing plate.

12. The springless pump of claim 7, wherein the transmission component comprises a connecting rod, wherein a first end of the connecting rod is provided with at least one first aperture, a first piston rod is connected to the first pressing head, at least one first protruding post is formed on an outer peripheral wall of the first piston rod, and the first aperture is mated with the first protruding post;

a second end of the connecting rod is provided with at least one second aperture, a second piston rod is connected to the second pressing head, at least one second protruding post is formed on an outer peripheral wall of the second piston rod, and the second aperture is mated with the second protruding post; and a pivoting portion is formed between the first end and the second end of the connecting rod, and the bearing component comprises a fulcrum portion formed on the top of the threaded sleeve, wherein the fulcrum portion is located between the two mounting holes, and the pivoting portion of the connecting rod is rotatably mated on the fulcrum portion.

13. The springless pump of claim 7, wherein the transmission component comprises a gear train, and the bearing component comprises a gear mounting portion formed at the top of the threaded sleeve, wherein the gear train comprises:

a gear rotatably mounted on the gear mounting portion;

a first rack, which is formed on a first piston rod connected to the first pressing head, and meshes with one side of the gear; and a second rack, which is formed on a second piston rod connected to the second pressing head, and meshes with the other side of the gear.

14. The springless pump of claim 4, wherein the fulcrum portion is formed on the threaded sleeve; or the fulcrum portion is clamped and fixed between the threaded sleeve and the container, or the fulcrum portion is formed on the container.

15. The springless pump of claim 4, wherein a rod part of the fulcrum portion is foldable and comprises a first segment and a second segment, the first segment being able to be switched between a first position in which the first segment is folded on the second segment, and a second position in which the first segment is aligned with the second segment to form a straight line.

16. The springless pump of claim 4, wherein the fulcrum portion comprises a sleeve and a ratcheted rod, wherein one end of the ratcheted rod is connected to the pressing plate, and the other end of the ratcheted rod comprises a ratchet and is slidably accommodated in the sleeve.

17. The springless pump of claim 3, wherein the transmission component comprises a rotary restoring member, the rotary restoring member comprises an operation portion and at least one abutment portion suspended from a body of the rotary restoring member, and a slope is formed on a free end of the abutment portion; and the bearing component comprises a mating slope formed on a neck of the threaded sleeve, and the mating slope is mated with the slope of the abutment portion.

18. The springless pump of claim 1, wherein the springless pump is a hand-triggered pump, wherein the stationary part comprises the threaded sleeve and a cylinder formed or mounted on the threaded sleeve, and the movable part comprises a piston rod reciprocably accommodated in the cylinder and a trigger, a first end of the trigger being connected to the piston rod, and a second end of the trigger being a free end; and wherein the bearing component is a fulcrum portion formed on the stationary portion, and the trigger is rotatably connected to the fulcrum portion at an intermediate point between the first end and the second end, such that a part of the trigger between the intermediate point and the second end constitutes the transmission part of the restoring mechanism.

19. The springless pump of claim 18, wherein a limiting member is further formed on the fulcrum portion.

* * * * *